US005221935A

United States Patent [19]

Uzita

[11] Patent Number: 5,221,935

[45] Date of Patent: Jun. 22, 1993

[54] WASTE INK RECEIVING CARTRIDGE AND INK RECORDING APPARATUS USING SAID CARTRIDGE

[75] Inventor: Toshihiko Uzita, Yamato, Japan

[73] Assignee: Canon Kabushiki Kaisha, Tokyo, Japan

[21] Appl. No.: 655,146

[22] Filed: Feb. 14, 1991

[30] Foreign Application Priority Data

| | | | |
|---|---|---|---|
| Feb. 15, 1990 | [JP] | Japan | 2-34550 |
| Feb. 4, 1991 | [JP] | Japan | 3-013393 |
| Feb. 4, 1991 | [JP] | Japan | 3-013397 |

[51] Int. Cl.[5] ..... B41J 2/185

[52] U.S. Cl. ..... 346/140 R

[58] Field of Search ..... 346/140 R

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,695,824 | 9/1987 | Tazaki | 346/140 R |
| 4,723,129 | 2/1988 | Endo et al. | 346/1.1 |
| 4,740,796 | 4/1988 | Endo et al. | 346/1.1 |
| 4,760,409 | 7/1988 | Kiyohara et al. | 346/140 R |
| 4,853,708 | 8/1989 | Walters | 346/75 |
| 4,901,094 | 2/1990 | Iwagami et al. | 346/140 R |
| 4,965,596 | 10/1990 | Nagoshi et al. | 346/140 R |

FOREIGN PATENT DOCUMENTS

| | | | |
|---|---|---|---|
| 0108153 | 6/1983 | Japan | 346/140 |
| 59-042963 | 9/1984 | Japan . | |
| 61-284444 | 12/1986 | Japan . | |
| 0261451 | 11/1987 | Japan | 346/140 |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

A waste ink receiving cartridge detachable from an ink recording apparatus and internally provided with a liquid absorbing member for receiving waste ink from the recording apparatus, characterized by comprising a liquid non-absorbing sheet member for dispersing waste ink at least to the longitudinal direction of said liquid absorbing member along an external surface of said liquid absorbing member.

29 Claims, 11 Drawing Sheets

WASTE INK RECEIVING CARTRIDGE AND INK RECORDING APPARATUS USING SAID CARTRIDGE

BACKGROUND OF THE INVENTION

1. Field of the Invention

The present invention relates to a waste ink receiving cartridge for receiving the waste ink which was not used for recording, or an ink cartridge and an ink recording apparatus with the ink cartridge, containing an ink reservoir and a waste ink receiving member within the cartridge to allow for the supply of ink and the disposal of waste ink with one unit.

2. Related Background Art

Conventionally, in an ink recording apparatus, a recovery operation or preparatory ink exhaust processing for stabilizing the discharge characteristic prior to its use is performed, because discharge failure may occur due to mixing of bubbles, dirt, meniscus regression on ink discharge ports at a tip of a nozzle in printing with a recording head, causing unclear printing. In such a case, the ink within a nozzle is extruded or conversely sucked, or predischarged irrespective of the recording, with various mechanisms, so that most of the ink can be recovered. Thus, a waste ink reservoir is needed in order to dispose of, or reserve temporarily, the ink that was extruded or sucked, or discharged and exhausted from discharge ports, regardless of the printing. In addition, in a continuance method where the ink is continuously discharged and only the required amount of ink is selectively used to record onto a recording medium, there is provided a waste ink reservoir for temporarily reserving a quantity of discharged ink which was not used for the printing.

The structure of waste ink reservoir is generally made of a high water absorbing member and is contained within a cartridge, so that no ink may leak outside from a supply port for the waste ink reservoir. To this end, an absorbing member for sucking the ink which projects outward from an opening portion of a drainage bottle is well known, as disclosed in Japanese Laid-Open Patent Application No. 59-42963 gazette.

For this type of apparatus for using the ink, such as an ink recording apparatus, the waste ink path for directing produced waste ink to the waste ink reservoir is arranged by one on account of structure, cost and so on. Thus, the waste ink, after reaching to a particular fixed position of the water absorbing member, is generally diffused within a absorbing member by the capillary effect, depending on the ink absorbency of the water absorbing member.

In such an ink cartridge, the following problem was resolved by the present inventor. That is, when a time interval from the first waste ink operation to the next waste ink operation is sufficiently long, volatile components of ink may evaporate, so that the ink fixes within the absorbing member. In this way, if the waste ink fixes at a waste ink absorbing inlet portion of the water absorbing member, the capillary power at that portion is weakened, so that when waste ink enters later, it may not be sucked and diffused at a sufficiently high speed, thereby causing an overflow of the waste ink within the cartridge. Further, in taking out the ink cartridge from an ink jet recording apparatus in that state, there often occurs a failure that the ink as above described may leak from an atmosphere communicating port or waste ink receiving port of the ink cartridge, because the ink cartridge is inclined or oscillated.

On the other hand, even if the fixing of ink does not occur, a high viscous waste ink is difficult to reach to the water absorbing member relatively remote from the portion of the waste ink absorbing inlet, thereby causing a problem that the waste ink absorbency in the whole water absorbing member is substantially reduced. And particularly for a cartridge with a construction that the ink is stored in a different chamber from that of the above mentioned ink absorbing member in a space where an ink storage portion containing the ink to be used is partitioned, the reduction of absorbency as described above may render its withdrawal capability almost naught.

Furthermore, in a recording apparatus of a type in which the above mentioned ink storage member is bag-shaped and the ink is supplied in accordance with the consumption of ink, if the ink is stored within the same space as that of the above mentioned waste ink absorbing member, a bag-shaped ink storage member and the ink absorbing member will have made contact with each other. In this case, if the ink absorbing member itself increases its volume in part due to a partial absorption from various causes as above described, problems may occur such that the ink absorbing member presses against the bag-shaped storage member regardless of a deformation in accordance with the consumption of ink, which may yield an excessive supply of ink, and unnecessary ink discharge from the recording apparatus, or conversely, the stable supply of ink will be deteriorated by interfering with the deformation in accordance with the consumption of ink, resulting in a recording failure.

SUMMARY OF THE INVENTION

It is a main object of the present invention to resolve the problems as above described, and to provide a reliable waste ink receiving cartridge which can prevent the water absorbing capability of a waste ink absorbing member from decreasing due to the fixing of waste ink, with less leakage of the ink from a waste ink reservoir.

Another object of the present invention is to provide a recording apparatus which can perform the recording stably for a long period, as the result of preventing a failure of supplying ink from a recording ink storage member contained within a cartridge for receiving waste ink to the inside of the apparatus by withdrawing waste ink from a recording apparatus surely, and/or surely withdrawing waste ink produced by recovery means such as predischarge, suction recovery, and pressure recovery which is required for the recording, without contaminating the apparatus.

A further object of the present invention is to provide a recording apparatus which can greatly reduce the likelihood that the ink sticking to an end portion of member for guiding waste ink into a waste ink receiving cartridge will fall down when the waste ink receiving cartridge is released from the operation of apparatus.

Especially, the present invention resides in providing a recording apparatus which can shorten the time for returning to the optimum recording operation, wherein a decreased life of a recording head itself which will occur due to inefficient supply of ink can be prevented, or the recovery operation from a simple operation to a complex one producing a quantity of waste ink is covered to maintain the recording ink more appropriate, when recording means is a recording head which uses electricity-heat conversion elements for generating the heat energy.

A still further object of the present invention is to provide a waste ink receiving cartridge which can improve and stabilize the ink supply capability or utilization efficiency by supporting a portion of an ink storage bag with an expandable waste ink absorbing member from below.

Another object of the present invention is to provide a waste ink receiving cartridge detachable from an ink recording apparatus and internally having a liquid absorbing member for receiving waste ink, characterized by comprising a liquid non-absorbing sheet member for dispersing waste ink at least in the longitudinal direction of the above mentioned liquid absorbing member along an external surface of the above mentioned liquid absorbing member.

Another object of the present invention is to provide a waste ink receiving cartridge detachable from an ink recording apparatus and internally having a liquid absorbing member for receiving waste ink, characterized by comprising a liquid non-absorbing sheet member for dispersing waste ink at least in the longitudinal direction of the above mentioned liquid absorbing member along an external surface of the above mentioned liquid absorbing member, and wherein said sheet member can first receive waste ink from the ink recording apparatus ahead of the above mentioned liquid absorbing member.

Another object of the present invention is to provide an ink recording apparatus having a detachable waste ink receiving cartridge internally provided with ink recording means, recording medium conveying means, and a liquid absorbing member for receiving waste ink from the inside of the apparatus, characterized by comprising a waste ink guiding tube, wherein in a state that the apparatus has mounted the above mentioned waste ink receiving cartridge having a liquid non-absorbing sheet member for dispersing waste ink at least in the longitudinal direction of the above mentioned liquid absorbing member along an external surface of the above mentioned liquid absorbing member, it allows said sheet member within said waste ink receiving cartridge to first receive waste ink from the ink recording apparatus ahead of the above mentioned liquid absorbing member.

A further object of the present invention is to provide an ink recording apparatus having a detachable waste ink receiving cartridge internally provided with ink recording means, recording medium conveying means, and a liquid absorbing member for receiving waste ink from the inside of the apparatus, characterized in that the recording means for the above mentioned ink recording apparatus has electricity-heat conversion elements for causing the film boiling by applying the heat energy to the ink, and recording signal issuing means for said electricity-heat conversion elements, and the above mentioned waste ink receiving cartridge has a communicating portion to the atmosphere, wherein an ink storage bag for storing the ink which is supplied to the above mentioned recording apparatus is directly placed on the above mentioned liquid absorbing member, and a liquid non-absorbing member is provided between a bottom surface of the above mentioned cartridge and the above mentioned liquid absorbing member.

Another object of the present invention is to provide a waste ink receiving cartridge detachable from an ink recording apparatus and internally provided with a waste ink reserving member for receiving waste ink from the recording apparatus, characterized by comprising a waste ink absorbing member, and a liquid non-absorbing film disposed between said waste ink absorbing member and an inner wall of the cartridge and having a region in a substantially close contact state with the inner wall of the cartridge.

Still another object of the present invention is to provide a waste ink receiving cartridge detachable from an ink recording apparatus and internally provided with a waste ink reserving member for receiving waste ink from the recording apparatus, and a communicating portion to the atmosphere, characterized by comprising a waste ink absorbing member, a liquid non-absorbing film disposed between said waste ink absorbing member and an inner wall of the cartridge and having a region in a substantially close contact state with the inner wall of the cartridge, and an ink storage body, which is directly placed on an upper portion of said waste ink absorbing member, internally storing the ink for use in the recording and externally having a delivery portion for delivering said ink.

A further object of the present invention is to provide a waste ink receiving cartridge detachable from an ink recording apparatus and internally provided with a liquid absorbing member for receiving waste ink from the recording apparatus, characterized by comprising a liquid non-absorbing sheet member for dispersing waste ink at least to the longitudinal direction of the above mentioned liquid absorbing member along an external surface of the above mentioned liquid absorbing member, and which is interposed along a bottom surface of the above mentioned cartridge between the above mentioned liquid absorbing member and said bottom surface, and wherein waste ink from the above mentioned recording apparatus is distributed between said bottom surface and said sheet and over said sheet surface into the above mentioned liquid absorbing member.

A still further object of the present invention is to provide a recording apparatus characterized by comprising recording means containing electricity-heat conversion elements generating the heat energy for discharging the ink, recovery means for stabilizing the recording capability of said recording means, and a waste ink receiving cartridge detachable from the ink recording apparatus and internally comprising a liquid absorbing member for receiving waste ink from said recovery apparatus, and a liquid non-absorbing sheet member for dispersing waste ink at least in the longitudinal direction of the above mentioned liquid absorbing member provided along an external surface of the above mentioned liquid absorbing member, and which is interposed along a bottom surface of the above mentioned cartridge between the above mentioned liquid absorbing member and said bottom surface, and wherein waste ink from the above mentioned recording apparatus is distributed between said bottom surface and said sheet and over said sheet surface into the above mentioned liquid absorbing member.

Another object of the present invention is to provide a waste ink receiving cartridge detachable from an ink recording apparatus and internally provided with a liquid absorbing member for receiving waste ink from the recording apparatus, characterized in that said liquid absorbing member is constituted of a porous material expansible with the content of said waste ink, and comprising an ink storage portion for storing the ink to be supplied to the apparatus on said liquid absorbing member.

Another object of the present invention is to provide an ink receiving cartridge detachable from an ink recording apparatus and internally having an ink storage member for storing the ink to be supplied to the recording apparatus, and a liquid absorbing member for receiving waste ink from the recording apparatus, characterized by comprising a liquid non-absorbing sheet member for dispersing waste ink at least to the longitudinal direction of the above mentioned liquid absorbing member along an external lower surface of the above mentioned liquid absorbing member, as well as an information medium used for transmitting a characteristic of the ink stored in a portion of an upper surface of the cartridge body.

Other objects of the present invention will become apparent from the following description.

The present invention comprises, as a basic construction to accomplish the above described objects, for example, a liquid non-absorbing sheet member for dispersing waste ink at least in the longitudinal direction of a liquid absorbing member for receiving waste ink along an external surface of the above mentioned liquid absorbing member, and preferably, having said liquid non-absorbing sheet member interposed between the above mentioned liquid absorbing member and said bottom surface, and wherein waste ink from the above mentioned recording apparatus is distributed between said bottom surface and said sheet and over said sheet surface into the above mentioned liquid absorbing member.

The construction of an apparatus according to the present invention can be accomplished by that as defined in the claims as above described.

According to the present invention, each of the above described problems can be resolved and the invention associated with the objects as above described is provided, in that waste ink is diffused by a liquid non-absorbing sheet member, or isolated from a liquid absorbing member for receiving waste ink, and the waste ink distribution path is less evaporative than that of the liquid absorbing member.

The present invention is intended to resolve each or all of the above described problems, wherein an especially preferred construction includes a liquid non-absorbing sheet member for dispersing waste ink at least to the longitudinal direction of a liquid absorbing member for absorbing waste ink along an external surface of the above mentioned liquid absorbing member and which is interposed along a bottom surface (or an upper surface) of a cartridge between the above mentioned liquid absorbing member and said bottom surface, so that a minute space (in a substantially close contact state i.e., less than 20 μm) may be formed between the liquid non-absorbing sheet member and the bottom surface of the cartridge, whereby waste ink will spread all over this minute space at a higher speed that the ink absorbing speed with the above mentioned liquid absorbing member, and can be distributed around a periphery of the liquid non-absorbing sheet member or an opening portion thereof. Thus, the liquid non-absorbing sheet member can be stably carried on said bottom surface owing to the surface tension of existing waste ink, wherein a waste ink guide path sufficient to cause a minute capillary phenomenon for dispersing the ink can be secured. Accordingly, subsequent waste ink residual in part can be eliminated, and so the scattering problem of ink to the outside is resolved. At the same time, the ink withdrawal power over the cartridge is improved, so that the inconveniences as previously described can be resolved.

Furthermore, the stable supply of ink or the improvement of utilization efficiency can be accomplished by comprising a waste ink receiving member which is expansible, because a position of an ink bag placed on the waste ink receiving member can be maintained almost stably.

DETAILED DESCRIPTION OF PREFERRED EMBODIMENT

Figure 1A:
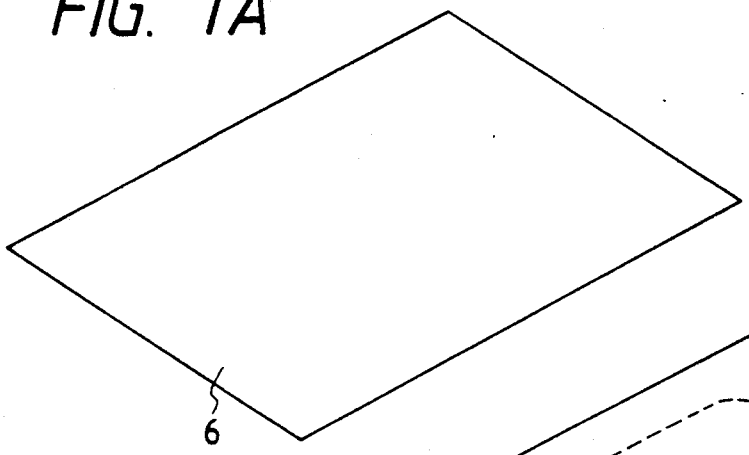
FIGS. 1A and 1B are perspective views of an ink cartridge used for an ink jet recording apparatus in accordance with the present invention.
Figure 1B:
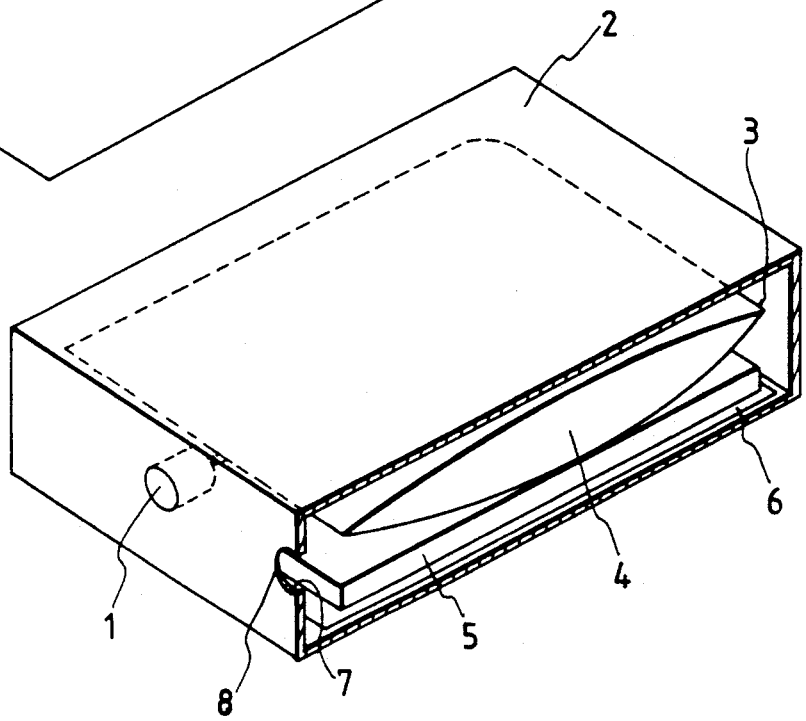

Referring now to the drawings, an example of the present invention will be described in detail. FIG. 1B is a perspective view of an ink cartridge which is a waste ink receiving cartridge according to the present invention, and FIG. 1A shows a film 6 useful in that cartridge. In FIG. 1, reference numeral 1 is a seal cap made of an elastic material such as silicone or butyl rubber, wherein it is connected to an ink bag 3 via a tube provided internally, thereby keeping the ink bag 3 in a tightly closed state. The seal cap 1 enables the supply of ink by fittingly connecting an ink supply tube within a recording apparatus, as is well known. The ink bag 3, of a flexible property, contains the ink 4 injected into the inside thereof. Reference numeral 2 is an ink cartridge outer package, which is shaped in accordance with an ink cartridge accommodation portion of an ink jet recording apparatus, generally with the molding of plastics so as to have no leakage of ink.

Reference numeral 5 is a waste ink absorbing member for absorbing waste ink discharged with the recovery operation through discharge ports on an ink jet head, where it is made of a highly absorbent material, for example, a high density fibrous structure such as absorbent paper or felt, a foaming material such as polyurethane, cellulose, PVA, EVA, or an absorbent member, as previously described, containing absorbent high molecular polymer such as acrylic acid graft starch, acrylic salt graft starch, vinyl alchol acrylic acid block copolymer, vinyl alchol acrylic salt block copolymer, bridged polyacrylic acid, bridged polyacrylic salt, denatured PVA, polystyrene sulfonic acid, cellulose ether, carboxymethyl cellulose. Reference numeral 6 is a sheet-like, non-absorbent film made of relatively flexible material, for example, a resin sheet such as polyester, vinyl chloride, PVA, cellulose, or any of various rubber sheets or metallic foil with a smoothness substantially less absorbent than the above mentioned water absorbing member.

In this example, the above mentioned waste ink receiving cartridge comprises an ink storage portion for storing ink to be supplied to the recording apparatus directly placed on a liquid absorbing member within the above mentioned waste ink receiving cartridge, and presses the above mentioned sheet member against a bottom surface of the above mentioned cartridge, thereby securely preventing a poor supply of ink from the ink storage portion due to the action as above indicated. It is needless to say that even with a waste ink receiving cartridge not having such an ink storage portion as above mentioned, the effect of waste ink withdrawal or ink scattering prevention as above described can be obtained.

Figure 2:
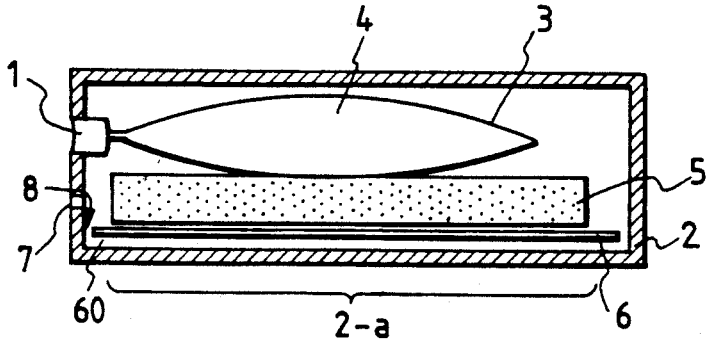
FIG. 2 is a cross-sectional view of the ink cartridge as shown in FIG. 1.

FIG. 2 is an explanatory view illustrating more clearly the construction as shown in FIG. 1, and also a cross-sectional view of an ink cartridge for explaining the features associated with the present invention. In this figure, a minute space 60 between a liquid non-absorbing sheet member 6 and a bottom surface of the cartridge is enlarged to scale, but it is actually in a substantially close contact state of less than 20 $\mu$m, and preferably, of less than several hundred angstrom. Further, in this figure, a liquid absorbing member 5 placed on a liquid non-absorbing sheet member 6 is shown spaced from the liquid non-absorbing sheet member 6, but actually, they make contact with each other under the pressure applied by the weight of an ink bag 3 placed upward, and that pressure also forces the liquid non-absorbing sheet member 6 to be in closely contact with the bottom surface of cartridge.

With the above construction, waste ink will spread all over this minute space 60 at a higher speed than an ink absorbing speed of the above mentioned liquid absorbing member, so that the ink can be dispersed around the periphery of the liquid non-absorbing sheet member 6 or an opening portion thereof. Thereby, the liquid non-absorbing sheet member can be stably carried on said bottom surface owing to the surface tension of existing waste ink, but waste ink dispersion guiding paths enough to cause a minute capillary phenomenon for dispersing the ink can be secured. Accordingly, subsequent waste ink residual in part can be eliminated, so that the scattering problem of ink to the outside is resolved. At the same time, the ink withdrawal capability of the whole cartridge is improved, thereby allowing the inconveniences as previously described to be resolved. Conversely, though conventionally, the ink withdrawal capability relied on an ink absorbing member only, which restricted materials to be used, the utilization restriction thereof can be greatly improved according to the present invention, and advantageously, the whole can be fabricated less expensively.

Here, a more specific description will be given. Waste ink produced with the recovery operation of a recording apparatus, as will be described later, passes through a hole 7 which is an ink withdrawal portion of cartridge to return to the inside of cartridge, and drops down on an end portion of film 6, as indicated by an arrow 8. Next, waste ink enters into a region **2-*a* between the film 6 and an outer package 2, in which the film 6 makes tight contact with a lower portion of inner surface on the outer package 2, due to the capillary force of waste ink. With this close adhesion of the film 6, the capillary force of ink is much greater, so that waste ink will diffuse under a lower surface of the film 6 promptly. If waste ink further increases, waste ink will escape through whole peripheral edge portions of the film 6 upward, and is absorbed by the waste ink absorbing member 5** located thereon.

Accordingly, waste ink passing into the ink cartridge is absorbed not only from a waste ink receiving port, but also always from the entire waste ink absorbing member, whereby the whole absorbing member can effectively contribute to the absorption of waste ink, and further, the absorbency of the absorbing member 5 is not deteriorated due to the fixing of ink even when the withdrawal of waste ink is left undone for a long time, because a wide range of absorbing area can be secured.

Figure 3:
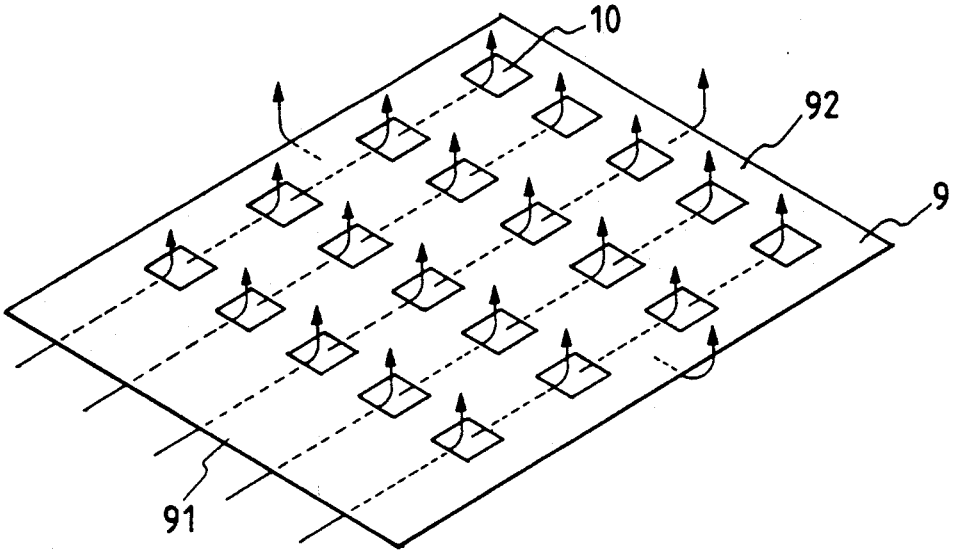
FIG. 3 and FIG. 4 are explanatory views of a film form to which the present invention is applicable, according to another example.
Figure 4:
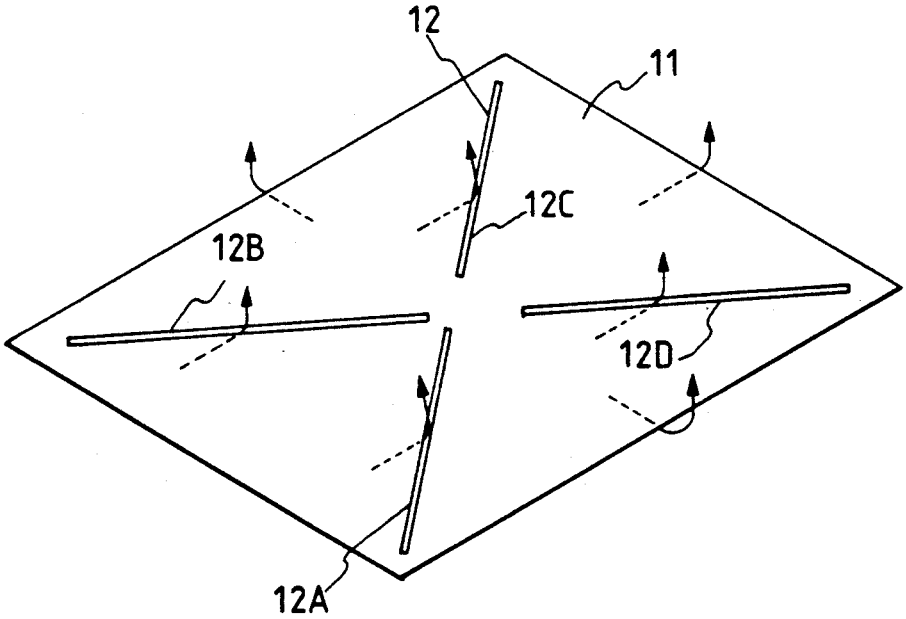

FIGS. 3 and 4 show examples of further improving the film 6 in the example as shown in FIGS. 1 and 2. Here a film 9 is provided with windows 10 spaced from each other in an appropriate predetermined interval in a plurality of rows and columns, which are opening portions for the film. Arrows as shown in the figure indicate typical flows of waste ink. Broken lines of arrows indicate the flow of waste ink passing through the above mentioned minute space 60, while solid lines indicate the portion of waste ink which is directly withdrawn into a lower surface centrally of the waste ink absorbing member 5, that is, ink liquid absorbing material, via those windows 10. Note that arrows as shown on the peripheral edges of the film 9 indicate the flow of ink overflowing therefrom and passing over the film, or being directly absorbed into side portions of the waste ink absorbing member. Reference numeral 91 indicates an edge portion on the waste ink receiving side for the film 9, while 92 indicates the other edge portion opposite to edge portion 91 in the longitudinal direction of the film 9, i.e., the longitudinal direction of the waste ink absorbing member 5.

In this example, the ink transfer into the absorbing member is very efficiently carried out after the above mentioned minute space 60 is filled with waste ink more quickly than for an example as shown in FIGS. 1 and 2, because the transfer area is further increased in addition to peripheral edge portions of film, and evenly distributed over an inner area of the absorbing member. Thereby, waste ink diffused under the film 9 is more uniformly transferred into the upper waste ink absorbing member, so that the effect of the present invention can be further improved.

Furthermore, in this example, formation positions of the above mentioned windows 10 are distributed slightly far away from the edge portion 91 of film in the longitudinal direction as above indicated. This is because at the area of waste ink receiving portion, waste ink will pass over the film and be directly absorbed into the waste ink receiving portion side of the absorbing member 5, which can positively further enhance the effect of dispersing waste ink into the other edge portion 92 in the longitudinal direction as above indicated. The shape of windows as above shown is limited to a square, but may be a polygon or a circle. Preferably, if the size of the windows them is such that the absorbing member 5 prior to absorbing ink is not directly in contact with a bottom surface of cartridge, it is preferable for causing the minute space 60 to exhibit its action to the maximum. Windows may have different sizes. In such a case, it is preferable to widen the ink absorbing area by increasing the size of windows in going further away from the vicinity of an ink receiving port.

FIG. 4 shows another example of film 9 different from that as shown in FIG. 3. This example, which is a variation of film 9 improved from the film 6 in the example as shown in FIGS. 1 and 2, show a film 11 provided with slit-like windows 12 corresponding to windows 10 as previously described.

In this example, four slit-like windows 12A, 12B, 12C and 12D extends from a central portion into angular portions. With this configuration, after the minute space 60 between the film 11 and a bottom surface of cartridge is promptly filled with waste ink from an opening 7 which is a waste ink receiving portion mal-distributed from a center toward a slit 12A, the ink transfer into the absorbing member 5 is carried out through these slits 12 and via the peripheral portions of film. In this example, in addition to the same effect as that shown in FIG. 3, the absorption of waste ink can be distributed on diagonal lines of film, and particularly, positively accomplished into a central region thereof. If this slit is formed by punching into the bottom surface, quite small burrs are formed toward the minute space 60, but can further improve the effect of dispersing waste ink. That is, waste ink is first conveyed in the direction of being guided by burrs.

These windows 10 may be a combination of those as shown in FIG. 3 and FIG. 4.

From the technical viewpoint, if ribs smaller than a thickness of film are provided in the minute space 60 for providing a the spacer effect, a superior waste ink dispersing effect can be obtained, even if the above mentioned windows may not be formed. Such ribs may be provided on either the film itself or the bottom surface of cartridge, but it is important to have a configuration of allowing the function of the minute space 60 to be exhibited as above described.

A film formed with opening portions, such as windows as above described, falls within the scope of the present invention, as it is disposed on an upper surface of waste ink absorbing member 5, but comprises a liquid non-absorbing sheet member for dispersing waste ink at least in the longitudinal direction of the liquid absorbing member along an external surface of the above mentioned liquid absorbing member.

Figure 5:
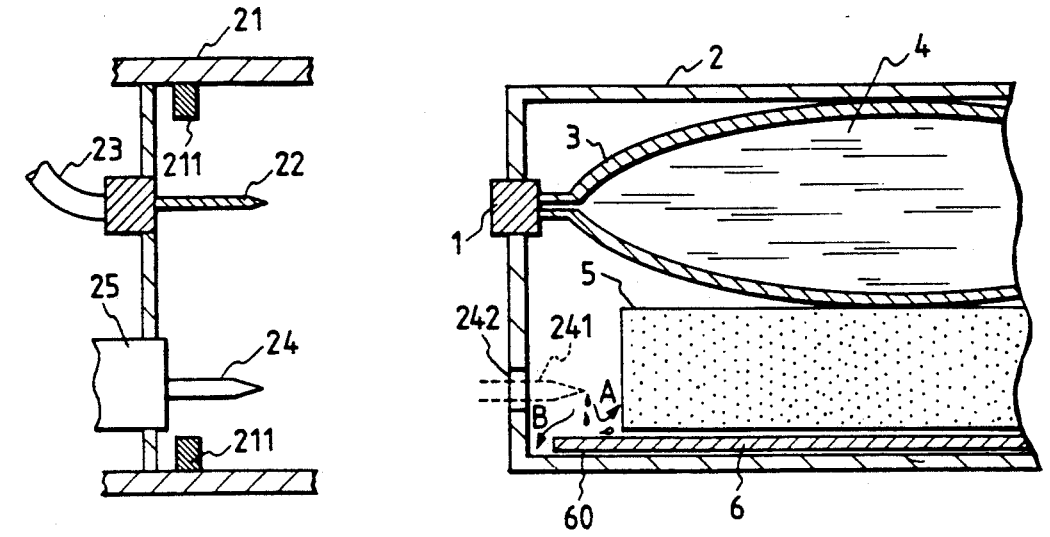
FIG. 5 is a detailed explanatory view of a recording apparatus according to an example of the present invention.

FIG. 5 is an explanatory view showing the configuration of an essential part for mounting the ink cartridge as shown in FIG. 2 onto the recording apparatus of the present invention. In this figure, an ink recording apparatus provided with a detachable waste ink receiving cartridge comprising internally ink recording means and recording medium conveying means, not shown, and a liquid absorbing member for receiving waste ink from the inside of apparatus is characterized in that, in a state where the apparatus has mounted the above mentioned waste ink cartridge comprising a liquid non-absorbing sheet member for dispersing waste ink at least in the longitudinal direction of the above mentioned liquid absorbing member along an external surface of the above mentioned liquid absorbing member, a waste ink guide tube for enabling waste ink from the ink recording apparatus to be first delivered onto said sheet member within said waste ink receiving cartridge ahead of the above mentioned liquid absorbing member has its end portion positioned at a waste ink receiving region of the above mentioned sheet member interposed along a bottom surface of the above mentioned cartridge between the above mentioned liquid absorbing member and said bottom surface, to which the above mentioned liquid absorbing member is not opposed.

The waste ink receiving cartridge according to this example clearly indicates that the liquid non-absorbing sheet member first receives waste ink from the ink recording apparatus prior to the above mentioned liquid absorbing member.

In FIG. 5, 22 is a needle for delivering the recording ink from the bag 3, wherein it is securely fixed within the recording apparatus in a state where it communicates with the ink supply tube 23 for supplying the ink to the recording head, not shown. 25 is a guide member for conducting waste ink exhausted by recovery means within the recording apparatus to the waste ink guide tube 24, which serves to deliver waste ink from the ink recording apparatus first to the film 6 that is the liquid non-absorbing sheet member, prior to the above mentioned liquid absorbing member 5, wherein it is fixed within the recording apparatus. As the needle 22 and the waste ink guide tube 24 are fixed at the positions corresponding to the seal cap 1 of cartridge 2 and the waste ink receiving port 242 which is also used as an atmosphere communicating port, respectively, the ink supply and waste ink receiving states can be simultaneously accomplished, if a top portion of the cartridge engages with a stop member 211, which acts as the positioning and stopper in the cartridge inserting direction of the cartridge loading portion 21 for the recording apparatus.

In the figure, 241 shows a position of the waste ink guide tube 24 to the cartridge of recording apparatus, wherein a tip thereof is located over an edge portion of film and spaced away from the absorbing member 5. Accordingly, waste ink passes into the absorbing member as indicated by an arrow A, and the minute space 60 between the film 6 and the cartridge as indicated by an arrow B. Thereby, waste ink is distributed in the directions A and B, and can be withdrawn securely with a more improved ink dispersion effect, even if a quantity of ink is delivered within the cartridge.

Figure 6:
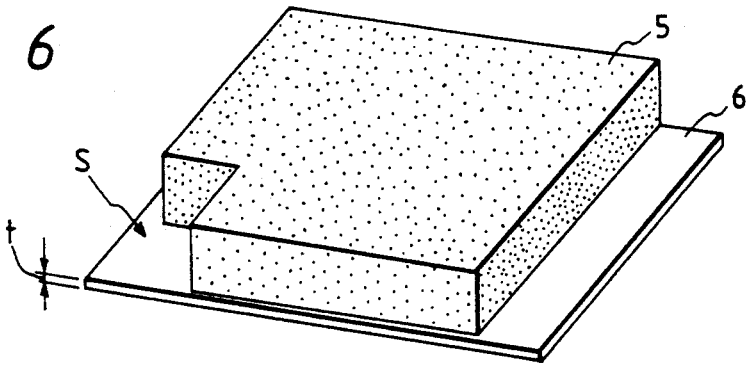
FIG. 6 is an explanatory view for an integrated configuration of an absorbing member and a film to which the present invention is applicable, according to an example.

The above mentioned liquid absorbing member can provide the effect of dispersing ink in the directions A and B if it is contained in the cartridge except for the above mentioned waste ink receiving region. FIG. 6 shows an essential part for assuring that construction according to an example.

FIG. 6 shows a configuration formed with the waste ink receiving region S where the above mentioned liquid absorbing member is not opposed to the above mentioned sheet member, by cutting away the absorbing member, or conversely a configuration provided with the absorbing member except for a region where an end portion of the waste ink guide tube is located. In addition, this example discloses a configuration with the above mentioned sheet member 6 and the above mentioned liquid absorbing member 5 integrally joined. With this integral configuration, as the absorbing member 5 is prevented from moving even if the above mentioned ink bag 3 is not disposed, there is an advantage that the waste ink absorption capability is always made stable.

The thickness t of the film in each example as above described may be arbitrary if it does not largely decrease the reception capacity of the absorbing member, but practically, it should be less than 500 μm, or preferably, less than 200 μm.

Figure 7:
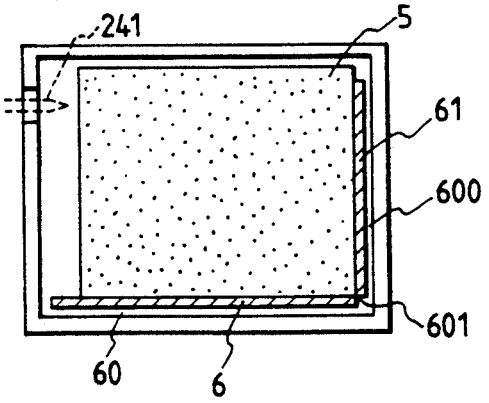
FIG. 7 is an explanatory view of a waste ink cartridge according to another example of the present invention.

FIG. 7 shows an example of configuration in which the longitudinal direction of the above mentioned absorbing member is not horizontal, but vertical. In this example, the minute space 60 is formed by disposing the above mentioned film between a bottom surface of cartridge as above described and the absorbing member, and a film 61 exhibiting the same effect as the above mentioned film 6 is provided between a surface of the absorbing member opposite to the attachment position 241 of the waste ink guide tube 24 and a side surface of cartridge opposed thereto. That is, the minute space 600 is formed by the film 61, to extend the absorbing capability at the bottom portion toward the vertical direction. Thereby, waste ink can be dispersed securely in the longitudinal direction of the absorbing member, so that the absorbing capability in a unit of time with the absorbing member can be further enhanced. Note that the films 6, 61 may be formed integrally, but a corner 601 for improving the waste ink absorbency at the bottom portion of the absorbing member should be open with opening windows of the above mentioned films, or by separating these films 6, 61.

In this example, the film 6 is provided, but a configuration where the film 6 is not provided, the film 61 is provided only on the other side face, or a composite type of them falls within the scope of the example.

With the above configuration, since whether or not the cartridge is already used is found through the above mentioned minute spaces 60, 600 by making the cartridge from a transparent or translucent material, an operator is advantageously protected from misoperation.

It should be noted that a water soluble compound with a relatively low molecular weight can be interposed in a clearance region between the sheet member and a lower body, in order to make the present invention more effective. This water soluble compound serves to efficiently diffuse the dye contained in the waste ink or ink. Thereby, waste ink will spread over the peripheral areas, or portions located away from the waste ink receiving portion, enabling the withdrawal of waste ink into the waste ink absorbing member.

The materials of dye or waste ink diffusion layer for exhibiting such function are water soluble compounds with relatively low molecular weights, such as glyceline, polyethylene glycol, diethylene glycol, triethylene glycol, polyvinyl alchol, hydroxyethyl cellulose, polyvinyl pyrrolidone, ethyl cellulose. The materials for the dye diffusion layer have preferably the viscosity of almost from 50 cp to 300 cp, within which waste ink can be dispersed appropriately.

Further, this dye diffusion layer is preferably applied so as to have a thickness of from 15 μm to 50 μm. When it is below 15 μm, the dye diffusion layer is difficult to apply evenly, thereby easily introducing bubbles and reducing the function. On the other hand, when it is above 50 μm, the dye diffusion layer is thickened, thereby reducing an apparent diffusion rate.

Note that the thickness of sheet member itself is preferably below 100 μm. If the thickness of the sheet member is too large, its rigidness becomes too strong, so that the close adhesion with the body may deteriorate, causing a reduced diffusion capability of waste ink. The lower limit is sufficient to be within the range useful for ordinary sheet members, and particularly, it should be within the range of not causing the diffusion capability for waste ink to be reduced.

Figure 9A:
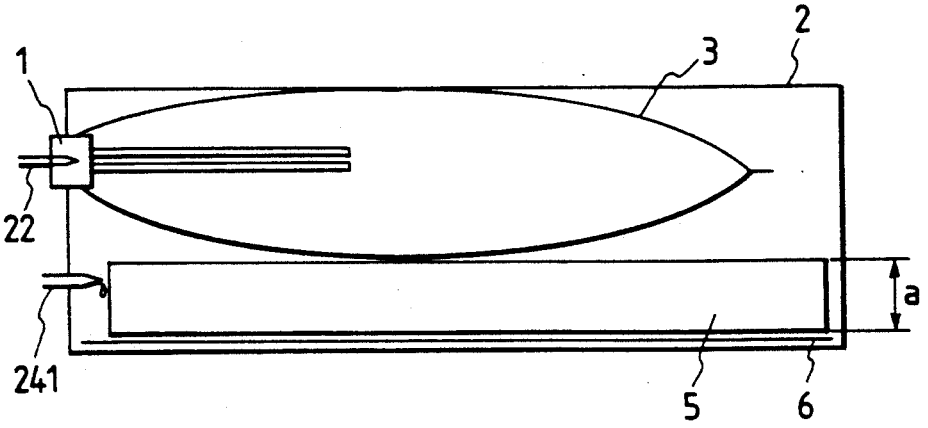
FIGS. 9A and 9B are cross-sectional views of an ink cartridge according to an embodiment of the present invention using an expansible ink absorbing member, showing an initial state and a nearly terminated state for supplying ink, respectively.
Figure 9B:
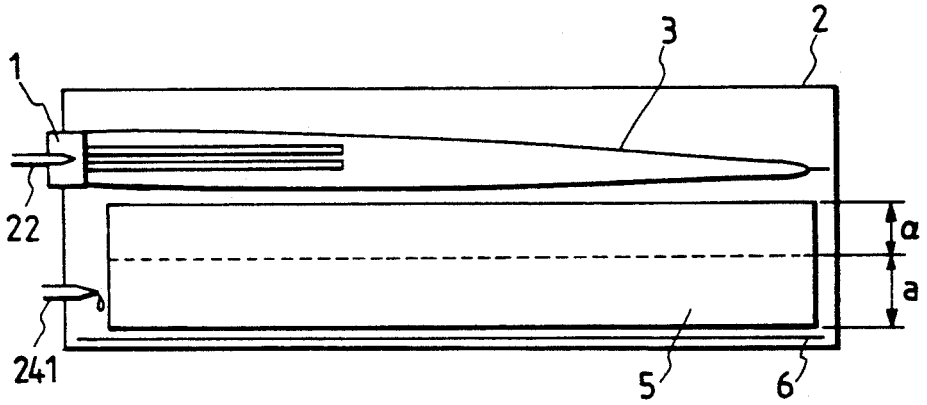
Figure 9C:
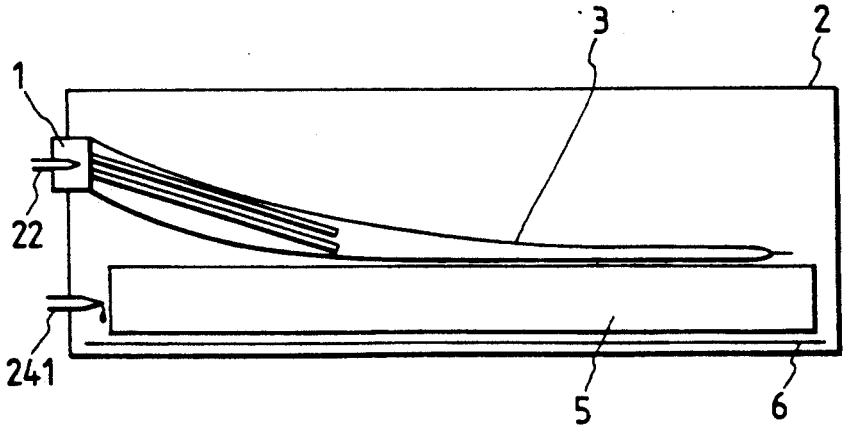
FIG. 9C is a cross-sectional view of a ink tank cartridge in a nearly terminated state for supplying ink with a non-expansible ink absorbing member.

With a cartridge in which the waste ink absorbing member 5 is placed on the bottom portion, and the ink bag 3 is disposed thereon, within an integral body containing the waste ink absorbing member 5 and the ink bag 3 storing the ink 4, the ink bag 3 will gradually collapse when the ink within the ink bag is consumed, and as shown in FIG. 9C, the ink stored within the ink bag is positioned downward in the gravitational direction below the ink inlet port 1, resulting in a state that the stable supply of ink can not be performed to the last. In this state, the ink is liable to remain within the ink bag, so that the consumption efficiency of ink may be reduced.

Therefore, the waste ink absorbing member 5 having the function for supporting the ink bag 3 from the underside is constructed so that the ink may be positioned at an area of the ink bag corresponding to a portion of the ink inlet port 1 even if the ink has been consumed.

To this end, the waste ink absorbing member 5 should have such a characteristic that it is expansible in absorbing waste ink.

An embodiment showing such a characteristic is shown in FIG. 9A and 9B, in the initial state where the ink is stored within the ink bag, the ink is stably supplied. And the waste ink absorbing member 5 is contained with a predetermined thickness a. If the ink is gradually consumed and so waste ink is withdrawn, the waste ink absorbing member 5 will inflate upward. As the supply of ink approaches to the end, the waste ink absorbing member 5 which has absorbed the ink is thickened by a thickness of o. With this increased thickness, the ink bag is placed in a state where it is positioned almost parallel to a portion of the ink inlet port, as shown in FIG. 9B, rather than a state where it hangs down as shown in FIG. 9C.

Such state of the ink bag allows the ink to be placed at a fixed position, a fixed and stable state for the supply of ink can be always maintained.

Thus, the ink within the ink bag can be effectively and stably supplied, and the consumption efficiency of ink is also improved.

Such a characteristic can be achieved by the waste ink absorbing member being made of a porous sponge-like material with the property that it gradually swells with the absorption and percolation of the ink after being compressed by a predetermined pressure.

The absorbing member, having a thickness that an upper surface of the absorbing member (with a thickness of a+o in FIG. 9B) is positioned near the ink outlet port in the state where waste ink has been completely withdrawn, is dried and pressed, so that the minute structure of the absorbing member is caused to crook until the plastic deformation, and to set permanently. In this way, the absorbing member having a thickness of a+c is fabricated by reducing its thickness to a, so that it gradually swells with the withdrawal of waste ink corresponding to the consumption of the ink, whereby the pressurized state against the ink bag is not created and the excellent supply of ink and withdrawal of waste ink can be accomplished.

In this case, of course, the waste ink absorbing member does not reduce its volume even if the received ink has all dried, and can maintain its volume, still with the thickness corresponding to the withdrawal amount of waste ink.

Particularly, with a configuration, as in this example, that a sheet 6 is provided under a lower surface of the waste ink tank so as to spread waste ink over the absorbing member, the swelling of the absorbing member does not occur partially, and the whole absorbing member can swell almost evenly and stably with no influence on the ink bag, so that the initial objects can be accomplished more securely.

An example of recording apparatus to which the examples as above described are applicable will be described with reference to FIG. 8.

Figure 8:
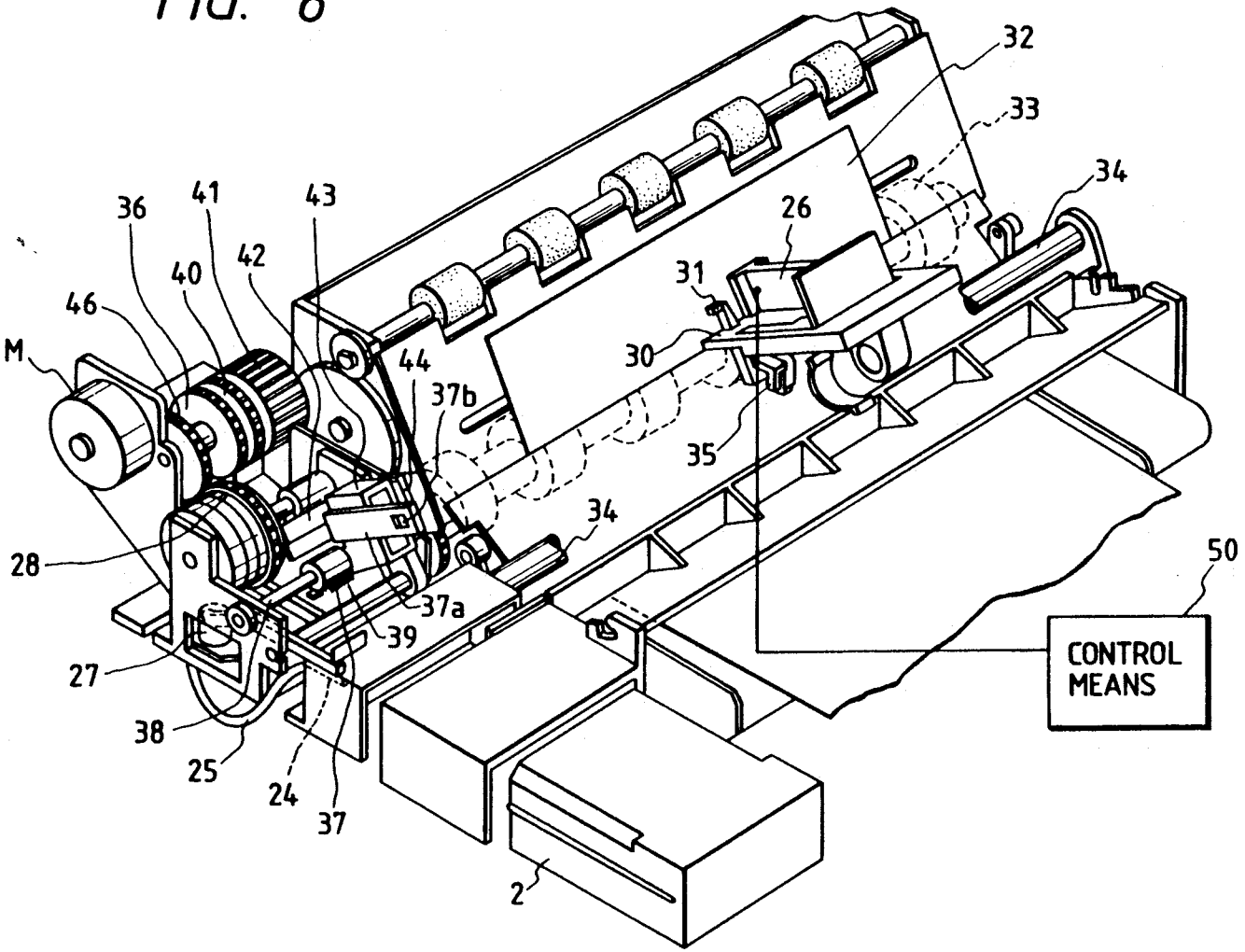
FIG. 8 is a schematic explanatory view showing recovery means in a recording apparatus according to an example of the present invention.

In FIG. 8, 26 is a recording head for discharging ink droplets, by driving the head with energy generation means (piezoelectric element or electricity-heat conversion body) in accordance with recording information, 30 is a carriage moving in the main scanning direction with the recording head 26 mounted thereon, 34 is a carriage shaft for carrying the carriage 30 freely slidingly, 32 is a recording medium where the recording is performed, and 35 is a feed roller for conveying the recording medium 32 in accordance with the recording condition.

M is a pulse motor which is a driving source for the feed roller 35 and the automatic paper feeding of recording medium 32 within a cassette, 37 is a pump carriage for recovering a cap unit and moving it parallel to the carriage shaft 34, 38 is a guide shaft for guiding the parallel movement of the pump carriage 30, and 39 is a return spring for biasing the pump carriage 30 toward the right direction in the figure. The pump carriage 37 is provided with an arm portion 37*a*, on a tip portion of which is provided a hole 37*b*, into which a projection 31 on the right side face of the carriage 30 can be fitted. When the carriage 30 moves left, the projection 31 is fitted into this hole 37*b*, so that the carriage 30 is prevented from rotating in the upward or downward direction when a cap 43 is applied on the discharge port face of the recording head 26. A slide gear carrier 42 for carrying a slide gear is movable in the run direction of carriage along a sliding axis. Thus, the carriage 30 moves, to bring the projection 31 of the carriage 30 into contact with the arm portion 37a of the pump carriage 37, so that they move integrally, thereby causing the slide gear 28 to move in the run direction of the carriage, to engage with a gear 46 driven by the pulse motor M, and to be rotatable. In the figure, 41 is a feed gear for transmitting the driving force to a paper feed gear, 40 is a gear for transmitting the paper feed driving force for the automatic paper feed, and 36 is a pump gear for transmitting the suction driving force to a suction pump 27 which is a suction recovery device.

Gears 36, 40 and 41 are able to perform the above mentioned driving in connection with well known driving force transmission means, not shown. In this example, the cap 43 is moved between positions abutting on and separating from the discharge portion of the recording head 26 with the driving force of the gear 28, in which it is needless to say that the cap 43 can be moved to those positions along with the movement of the carriage on a well known guide rail.

44 is a blade for cleaning the discharge portion surface of the recording head, wherein it is controllably moved between a cleaning position and a retracted position by a well known mechanism, not shown, to clean the recording head as required.

25 is a waste ink guide tube connected to the suction pump 27, having an end portion 24 for discharging waste ink into the waste ink absorbing member within the cartridge 2, as previously described.

50 is recovery control means for the recording head, wherein it drives the energy generator for the recording head, with the recording head being opposed to the cap 43, and controls the discharge of ink different from that for the recording (predischarge). And the control means 50 performs the control for withdrawing the ink within the cap 43 into the inside of the cartridge 2, with the activation of the pump 27, or for carrying out the suction recovery with the activation of the pump, in the state with the cap being pressed against the recording head, for the recovery of the recording head. The present invention includes at least one of these recovery means.

The supply of ink into the recording head 26 is made either from the cartridge 2 with a well known supply method, or from the other ink supply means.

With a recording apparatus to which the present invention is not applied, waste ink may fix around a portion of the absorbing member near a waste ink suction port, and weaken the capillary force of that portion, so that when waste ink subsequently enters, the ink can not be absorbed and dispersed at a sufficiently high rate, thereby causing such a failure that the overflow occurs within the cartridge, or the ink as above mentioned may leak through an atmosphere communicating port or waste ink receiving port, due to the inclination or vibration in taking out the ink cartridge from the ink jet recording apparatus, whereas with a recording apparatus as shown in FIG. 8 to which the configuration of the present invention is applied, these inconveniences can be resolved and the excellent recording can be accomplished.

Another example to which the present invention is applied will be described with reference to FIG. 10.

Figure 10:
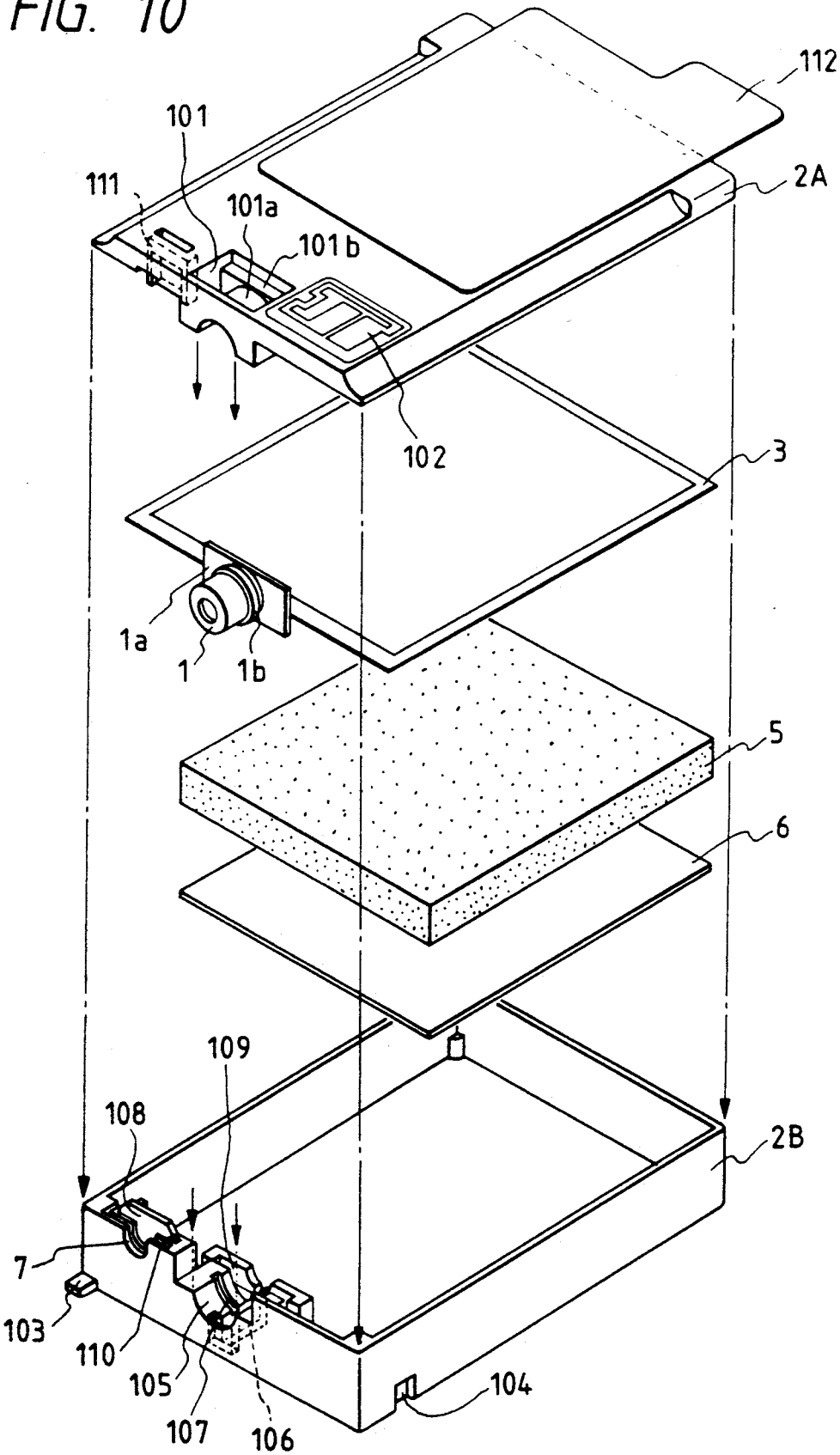
FIG. 10 is an exploded perspective view of an ink cartridge with another construction, according to the present invention.

In FIG. 10, 2A and 2B show upper and lower bodies of an ink tank cartridge, which contains and joins an ink bag 3 for storing the ink, a waste ink absorbing member 5 for receiving exhausted waste ink, and a sheet member 6 for spreading waste ink all over the waste ink absorbing member.

The upper body 2A is formed with a hold-down member 101*a* for holding down an ink delivery portion 1 for delivering the ink within the ink bag, along with a recess 101, at a corresponding portion of the upper body. This holddown member acts in cooperation with a holddown member 105 for holding down the ink delivery portion 1 provided on the corresponding portion of the lower body 2B.

The positional fixation of the ink delivery portion 1 is further favorably performed by means of a first positioning member 1*a* and a second positioning member 1*b* which are provided peripherally as ribs. These positioning member 1*a*, 1*b* each fit into recess 101*b* of the upper body 2A and recesses 107, 109 of the lower body 2B, so that the ink bag can be easily placed within the ink cartridge body. The satisfactory arrangement is obtained simply by fitting into those recesses, so that the assembling of the cartridge can be improved.

On a waste ink receiving portion 7 of the lower body 2B is formed a groove 110, into which a plate for preventing the scattering of ink to be exhausted into the waste ink absorbing member is inserted. The plate 108 must be properly introduced within the cartridge when a waste ink tube is inserted, and serves to prevent the scattering of waste ink or the dripping of waste ink from the waste ink tube in taking out a cartridge from the apparatus, wherein it is provided with slits on a central portion thereof, and the waste ink tube is inserted into the inside of cartridge by forcing these slits open. The plate 108 is configured to be only inserted into the groove 110 so that it can be easily and securely attached to the cartridge, whereby it mates with a groove 111 at the corresponding portion of the upper body 2A to accomplish a secure attachment and a improvement in assembling.

A cut-away portion 104 is provided on a part of a side face of the lower body 2B. And a projecting member 103 is provided on the side of an engagement surface with an ink supply tube. The projecting member 103 as above described serves to release the lock of a safety cover which is provided for assuring the safety, not to touch on an ink supply needle in loading an ink cartridge into the load portion of the apparatus, in which the loading of cartridge into the apparatus can be accomplished by releasing the locking with the projecting member 103.

The cut-away portion 104 serves as a click portion for allowing an operator to ensure the loading of cartridge into the loading portion of the apparatus, wherein it can determine the position of cartridge by engaging with a pin, not shown, on the apparatus, and cause the operator to recognize the completion of the loading with the impression of a click.

The upper body 2A is provided with an information medium as shown at 102. This information medium 102 is used to sense whether or not a cartridge is loaded into the apparatus, or perform the matching of the head driving condition for used ink, by transmitting the characteristics of stored ink to the apparatus. In this example, this information medium is provided as a resistor. Accordingly, the characteristics of stored ink can be recognized by the comparison with the translation table, depending on a setting value of resistance.

Between this information medium 102 and the waste ink receiving port 7 are interposed the ink delivery portion 1. Further, as the hold-down portion 101 corresponding to the ink delivery portion 1 is provided as a recess of the upper body 2A, and the information medium 102 is separated from the waste ink receiving port 7, the adhesion of ink can be reduced even if waste ink sticks onto the upper body 2A. For example, in the state where the ink spreads all over, as the ink can be trapped within the above mentioned recess 101, there is no fear that the ink may spread up to an area of the information medium. Accordingly, the information medium can properly function with no fear of the short circuit due to waste ink.

As waste ink can be efficiently dispersed all over the cartridge by means of a sheet member, the leak of waste ink from the waste ink receiving port can be prevented. And a fear of waste ink spreading to the information medium can be prevented. Furthermore, a slit 106 is provided on a part of holddown member 105 of the lower body 2B, which serves to hold down a part of the ink delivery portion. This slit extends up to a disposition area of the waste ink absorbing member, and thus, can appropriately take in the ink leaking from the ink delivery port or the ink supply tube which may occur at the loading or detaching of a cartridge into the apparatus. Accordingly, there is no fear that such ink will stick to the upper portion of ink cartridge, and contaminate the information medium.

The cut-away portion 104, the information medium 102, and the ink supply needle of the apparatus communicating to the ink at the ink delivery port, function in a sequence of 1 ink communication, 2 reading of the information medium, and 3 engagement of cut-away portion, so that preferably, the delivery of ink and the reading of ink characteristics can be securely carried out. Note that 112 is a tongue for extracting a cartridge from the apparatus. In this example, this is a resin coated paper with a superior strength, and can be folded at a broken line portion to properly serve only for the extraction.

Such a slit 106 is intended to resolve the following problems.

That is, when a cartridge is normally connected to the ink jet recording apparatus, it does not have to be disconnected from there until the ink within the cartridge becomes empty, but there are some cases that the ink cartridge must be disconnected based on a judgement of an operator, for example, when the operator wants to check the residual gas, when the ink jet recording apparatus is not used for a long term, when the type of ink is changed, or when the ink jet recording apparatus is transported or conveyed. In such a case, a hole of the rubber plug for connection which is opened by the hollow needle as previously described is permanently deformed, so that there is a possibility that the residual ink within the ink bag may leak outside. To prevent such leak, the rubber plug is made from a rubber material with the permanent deformation due to the insertion of the hollow needle to be as little as possible, and further, is precompressed by a metallic ring from the periphery thereof, or the hole formed as above mentioned is blocked up with the combination of two or more types of rubber plugs with different properties, but a lot of parts are needed, with more difficult assembling and higher cost, and it is difficult to block up the hole quickly and completely, immediately after the ink cartridge is removed, whereby there is a problem that some residual ink may leak to the outside to spoil user's clothes or the ink jet recording apparatus.

Referring now to the drawings, an example of slit 106 will be described in detail to resolve the above mentioned problems.

Figure 14:
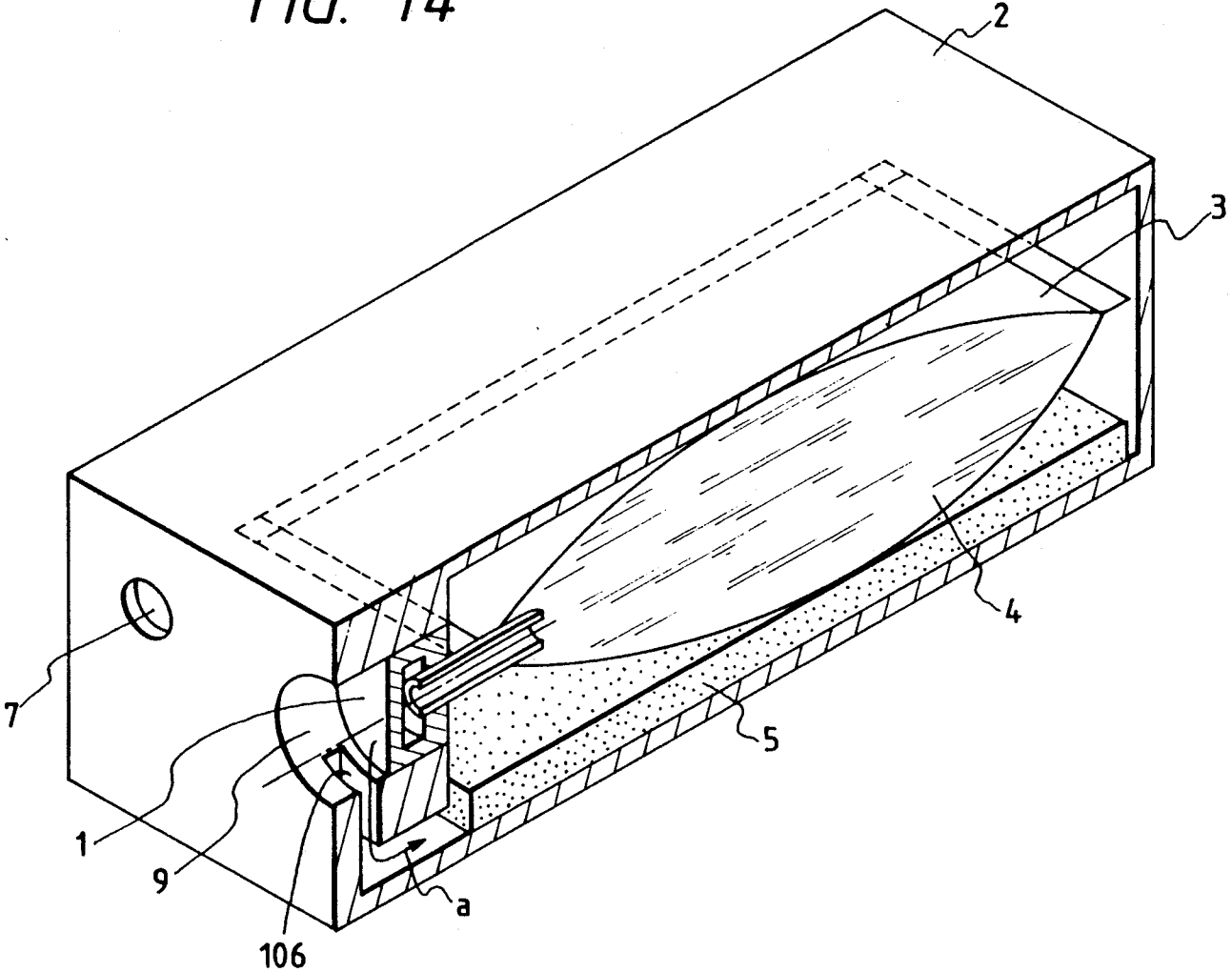
FIG. 14 is a cross-sectional perspective view of an ink cartridge according to the present invention.

FIG. 14 is a cross-sectional perspective view of an ink cartridge according to the present invention.

In FIG. 14, 1 is a cap made of an elastic material such as silicone or butyl rubber, wherein it is connected to an ink bag 3 via a tube provided internally. As shown, the cap 1 is fixed internally of an outer package of the ink cartridge. The ink bag 3, of a flexible property, contains the ink 4 injected into the inside thereof. 2 is an ink cartridge outer package, which is shaped in accordance with an ink cartridge accommodation portion of ink jet recording apparatus, generally with the molding of plastics.

5 is a waste ink absorbing member for absorbing waste ink discharged with the recovery operation through discharge ports on the ink jet head, where it is made of a highly absorbent material.

7 is a hole for receiving waste ink discharged from the ink jet recording apparatus, and 106 is a flow path provided under a small compartment 9 between the cap 1 and the ink cartridge outer surface, in which it communicates to a space where the waste ink absorbing member 5 is secured.

When the ink cartridge is removed from the ink jet recording apparatus, and a hollow needle inserted into the cap 1 is pulled out, the hole opened by the hollow needle is left on the cap 1 due to a permanent deformation of the cap 1, so that residual ink 4 within the ink bag 3 may leak out of the cap 1. This leaked ink flows through the flow path 106 opened in the small compartment 9 into the waste ink absorbing member 5, as indicated by an arrow a, where it is absorbed, and thus does not leak out of the ink cartridge.

The ink remaining on the needle immediately after the hollow needle is extracted from the cartridge may leak can be withdrawn through the flow path 106, so that the contaminate due to the ink can be prevented.

Figure 15:
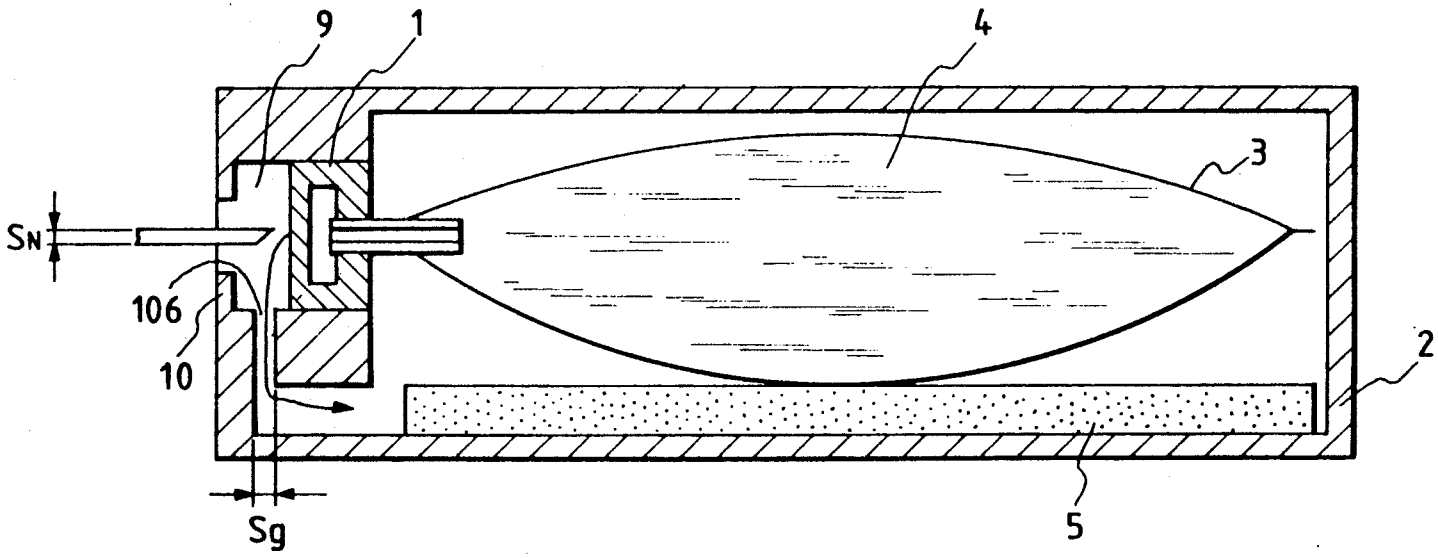
FIG. 15 shows an example different from the example as shown in FIG. 14.

FIG. 15 shows an example different from the example as shown in FIG. 14. Here a hole opened on the wall 10 of ink cartridge outer package 2 so as to communicate to the small compartment 9, has a smaller area than that of a hollow needle connection face on the cap 1, and is formed as a discontinuous face with respect to the small compartment 9. Accordingly, when the ink cartridge is removed from the ink jet recording apparatus, and residual ink leaks out from the cap 1, the leakage of ink can be blocked against the inner surface of the wall 10, even if the ink does not enter into a communicating tube for a while because the cartridge is subjected to vibration or impact or the connection face is directed downward, whereby a more reliable ink cartridge for the ink jet recording can be provided.

Note that assuming that an effective cross section of groove is Sg, and a cross section of hollow needle is Sn, the effective cross section Sg is preferably greater than the cross section Sn of hollow needle. This is because the leaked ink from the hole on the connection portion opened by the hollow needle is required to withdraw securely. However, if the groove is made too large, the ink absorbed into the waste ink absorbing member may flow reversely and overflow, whereby it is preferred that $Sn<Sn<Sg<5Sn$. This range is selected, in view of the surface tension of ink, so that ink droplets will enter or fall down into the groove to be absorbed into the absorbing member. For example, for a needle with a diameter of 1.2, its cross section is preferably greater than 1.13 mm.

In this way, by providing a connection portion between the hollow needle for supplying ink and the ink delivery portion internally of an outer wall of the cartridge, the ink leaking from the connection portion can be prevented from leaking out of the cartridge.

And by providing a conduit leading to the waste ink absorbing member within the cartridge on the area where the outer wall of cartridge and the connection portion are provided, the ink leaking from the connection portion or the hollow needle of the apparatus can be properly withdrawn.

The present invention has an excellent effect on a recording apparatus having a recording head with the ink jet recording method, especially such a method that the recording head is provided with means for generating the heat energy (e.g. electricity-heat conversion body or laser beam) as the energy useful for the discharge of ink, and wherein the state change of ink is caused by the above mentioned heat energy. With such method, a higher density and definition of the recording can be accomplished.

The typical construction and principle is preferably based on basic principles as disclosed U.S. Pat. No. 4,723,129 and No. 4,740,796 specifications, for example. This method is applicable to both so-called on-demand and continuance types, and particularly the on-demand type is more effective because the electricity-heat conversion body is disposed corresponding to a sheet and liquid path where the recording liquid (ink) is carried, and is driven by at least one drive signal applied thereto corresponding to a recording data and causing a rapid rise of temperature exceeding that of the nuclear boiling on the recording liquid, whereby the heat energy is generated in the electricity-heat conversion body, causing film boiling on the recording liquid in the vicinity of the heat acting surface of the recording head, so that bubbles in the recording liquid can be formed corresponding one-to-one to that drive signal. With the acting force produced in the process of bubble growth and contraction, the recording liquid is discharged through discharge ports to the atmosphere, whereby at least one droplet is formed. If this drive signal is pulse-shaped, the growth or contraction of bubbles can be performed immediately and appropriately, so that the discharge of recording liquid is more preferably accomplished with a particularly efficient response characteristic. The pulse-shaped drive signal is appropriate if it is as described in U.S. Pat. No. 4,463,359 and No. 4,345,262 specifications. Under the condition as described in U.S. Pat. No. 4,313,124 specification which is an invention concerning the temperature-rise rate of the above mentioned heat acting surface, more excellent recording can be performed.

If the construction of the recording head is a combination of discharge ports, liquid paths (straight or rectangular liquid paths) and electricity-heat conversion body, as disclosed in the above mentioned specifications, or an arrangement in which the heat acting portion is disposed in inflected area as described in U.S. Pat. No. 4,558,333 and No. 4,459,600 specifications, it falls within the scope of the present invention.

Furthermore, a full-line type recording head having a length corresponding to the maximum width of recording medium to be recorded is constructed in either a combination of a plurality of recording heads to fill that length, or an integrally formed recording head, and in either case, the present invention can more effectively exhibit the effects as above described.

In addition, the present invention is also effective for a replaceable chip type recording head which enables the electrical connection to the body of apparatus and the supply of ink from the body of apparatus because it is attached to the body of apparatus, or a cartridge type recording head within which the ink supply tank is integrally formed.

It is preferable that recovery means or preliminary auxiliary means for a recording head are added to the construction of a recording apparatus according to this invention, as it can make the effect of this invention more stable. More specifically, it includes capping means for the recording head, cleaning means, pressing or suction means, and preliminary heating means consisting of electricity-heat conversion body or other heating elements or a combination of both. And the predischarge mode for predischarging apart from the recording is also effective to allow stable recording.

Furthermore, as to the recording mode for a recording apparatus, the present invention is also significantly effective for an apparatus having not only the recording mode consisting of only a main color, such as black, but also having at least one of the composite color of different colors or the full color with mixed colors, whether the recording head is integrally formed or the combination of a plurality of recording heads.

Further, the recording apparatus with the recording feature using the ink jet recording head, according to the present invention, may be used for an image output terminal in an information processing equipment such as computer, a copying machine in combination with a reader, or a facsimile terminal equipment having the transmission and reception feature.

Figure 11:
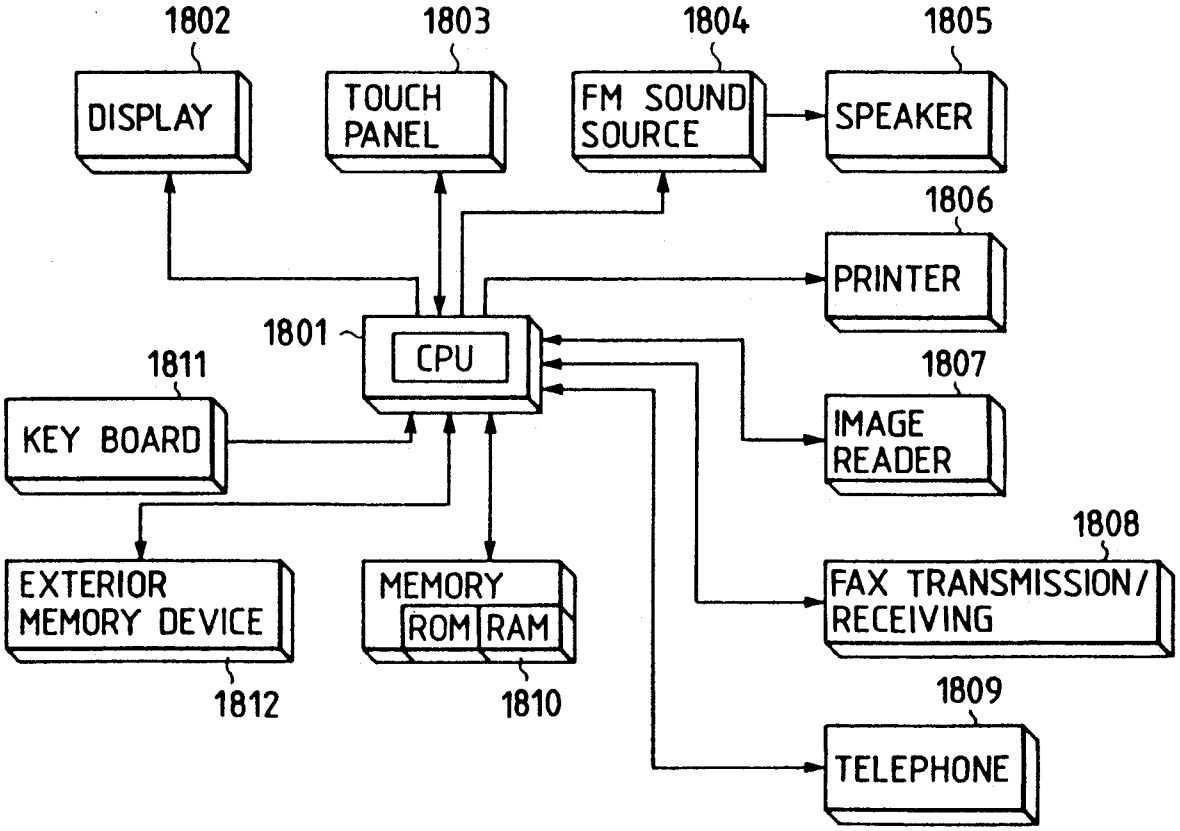
FIG. 11 is a block diagram showing a general configuration in which the present invention is applied to an information processing unit.

FIG. 11 is a block diagram showing a schematic configuration in which a recording apparatus of the present invention is applied to the information processing apparatus having the feature of word processor, personal computer, facsimile terminal equipment, or copying machine.

In the figure, 1801 is a control unit for controlling the whole apparatus, wherein it comprises CPU such as a microprocessor or various I/0 ports, and controls by outputting or inputting control or data signals to or from each of sections, respectively.

1802 is a display section, which displays various menus, document information, and image data read with an image reader 1807 on the screen thereof. 1803 is a transparent, pressure sensitive touch panel provided on the display section 1802, wherein it is used for the entry of items or coordinate values on the display section 1802 by depressing its surface with a finger or the like.

1804 is a FM (Frequency Modulation) sound source section, which makes the FM modulation for the music information created with the music editor, which is stored in the memory 1810 and the external storage device 1812 as the digital data. An electrical signal from the FM sound source section 1804 is converted into an audible sound by a speaker section 1805. A printer section 1806, useful as the output terminal for a personal computer, a facsimile terminal equipment, or a copying machine, is constructed of a recording apparatus to which the present invention is applied.

1807 is an image reader section which inputs by reading original data photoelectrically, and is provided midway on the conveying path of original to read facsimile or copying original, and other various types of originals. 1808 is a facsimile (FAX) transmission or reception section for transmitting original data read by the image reader section 1807 with the facsimile or receiving and decoding facsimile signals that are transmitted, having an interface facility with the outside. 1809 is a telephone section, comprising various telephone features, such as ordinary telephone function or automatic answering telephone function.

1810 is a memory section comprising a ROM for storing system programs, manager programs and other application programs, character fonts, and dictionary, as well as application programs loaded from the external storage device 1812, document information, and video RAM.

1811 is a keyboard section for inputting document information or various commands.

The external storage device 1812, which is a storage medium consisting of the floppy disk or hard disk, is used to store document information, music or audio data, and user's application programs.

Figure 12:
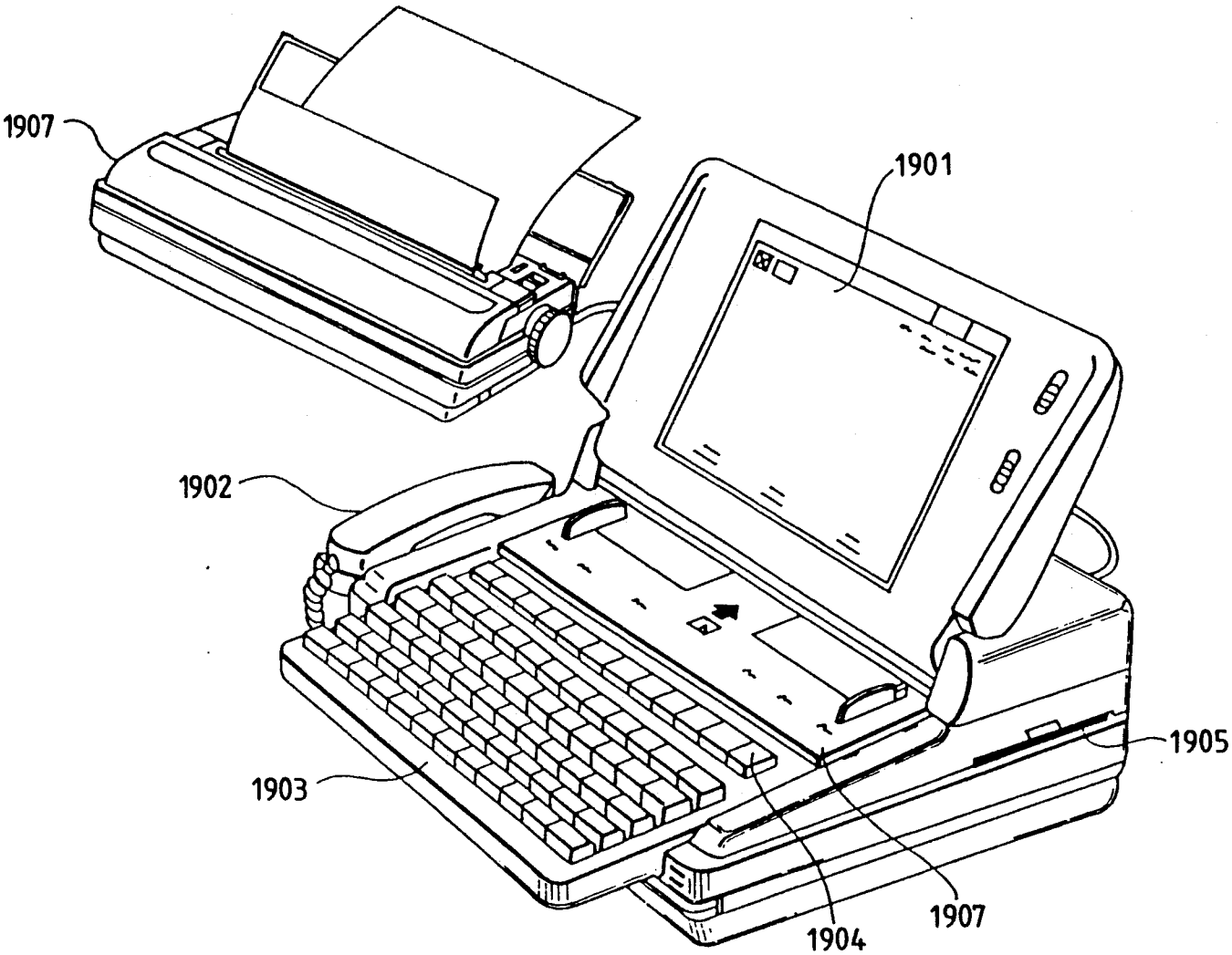
FIG. 12 is a typical appearance of the information processing unit as shown in FIG. 11.

FIG. 12 is a typical appearance view of the information processing apparatus as shown in FIG. 11.

In the figure, 1901 is a flat panel display, for displaying various menus, graphic data or documents. On this display 1901 is installed the touch panel 1803, which enables the entry of coordinates or item specifications by depressing a surface of the touch panel 1803 with a finger or the like. 1902 is a handset to be used when the apparatus functions as a telephone. The keyboard 1903 is detachably connected via a cord to the main body, and is used to input various documents or data. The keyboard 1903 is also provided with various types of function keys. 1905 is an insertion opening to the floppy disk unit.

1906 is a paper stack section for stacking papers to be read by the image reader section 1807, in which a read paper is exhausted from the rear portion of device. In the facsimile reception, received data is recorded by the ink jet printer 1907.

It should be noted that the display section 1802 as above described may be a CRT, but is preferably a flat panel of the liquid crystal display using a ferroelectric liquid crystal. This is because it is compact, thin, and light.

When the above mentioned information processing unit functions as a personal computer or word processor, various informations input from the keyboard 211 are processed according to a predetermined program in the control section 1801, and output to the printer 1806 as images.

When it functions as a receiver for the facsimile terminal equipment, the facsimile informations input via the transmission line from the FAX transmission and reception section 1808 are received and processed according to a predetermined program in the control section 1801, and output to the printer section 1806 as received images.

And when it functions as a copying machine, an original is read by the image reader section 1807, and original data that was read is output via the control section 1801 to the printer section 1806 as a copied image. Note that it functions as a transmitter for the facsimile terminal equipment, original data that was read by the image reader section 1807 is processed for transmission according to a predetermined program in the control section 1801, and transmitted via the FAX transmission and reception section 1802 to the transmission line.

Figure 13:
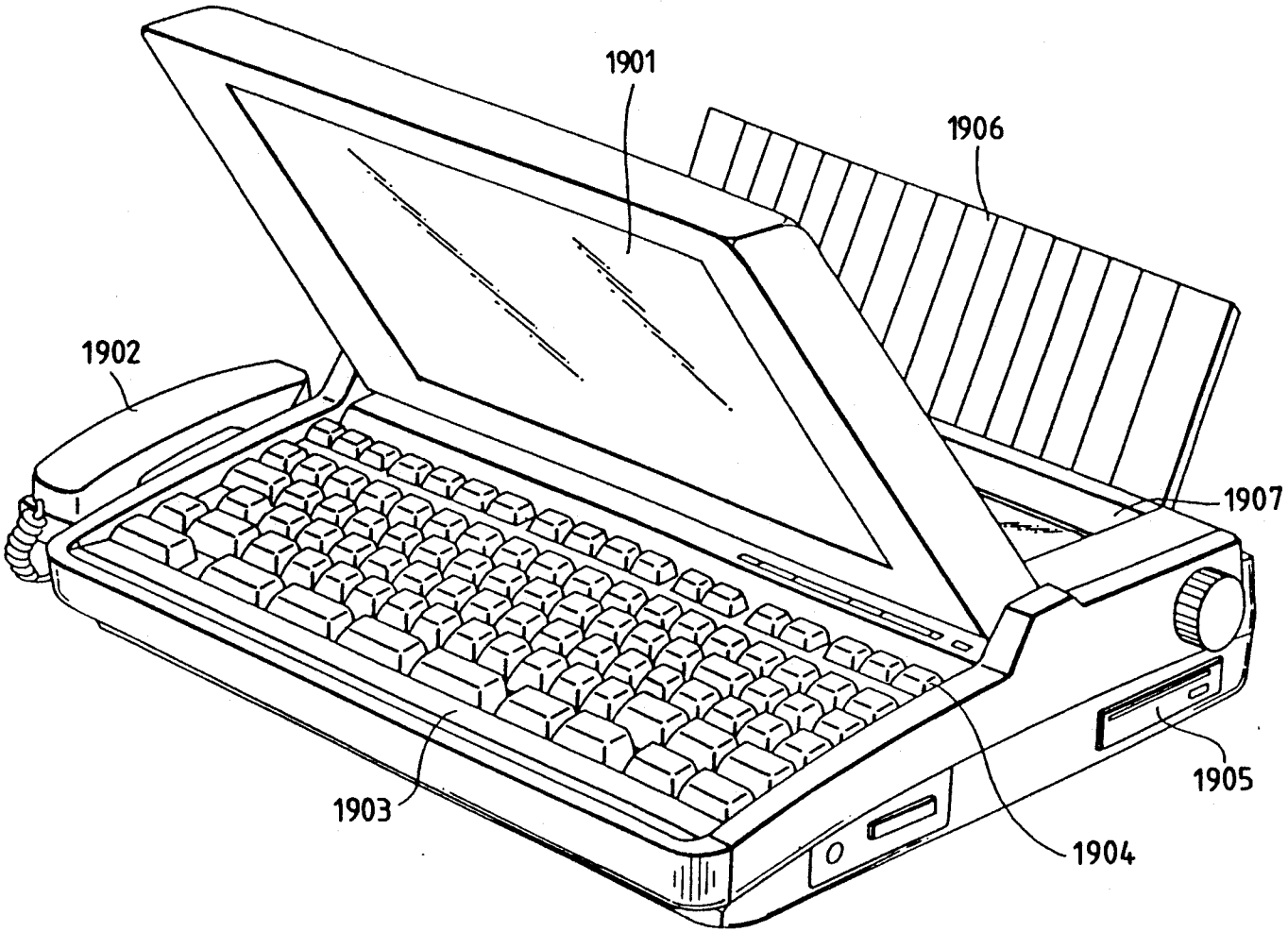
FIG. 13 is a typical appearance of an integral type information processing unit.

It should be noted that the above mentioned information processing device can be an integral type containing an ink jet printer within the main body, as shown in FIG. 13, in which its portability can be enhanced. In the same figure, like reference numerals refer to like parts throughout FIGS. 12 and 13.

The multifunction information processing device as above described can provide high quality recording images at a higher speed and with a lower noise, and further improve its functions, by applying a recording apparatus according to the present invention.

As clearly understood from the forgoing description, each effect of the present invention has been described, in which the fundamental effect of the present invention is to provide a reliable ink cartridge or recording apparatus with less leakage of waste ink by disposing a liquid non-absorbing film between a waste liquid absorbing member and an inner face of ink cartridge.

By using an expansible waste ink absorbing member, the absorbing member will increase its volume in absorbing the ink discharged in proportion with the consumption of ink within an ink bag, so that the ink bag can be maintained almost at a fixed position, whereby the supply of ink can be stabilized and a more improved utilization efficiency of ink can be accomplished.

I claim:

1. A waste ink receiving cartridge detachable from an ink recording apparatus and having internally a waste ink receiving member for receiving waste ink from the recording apparatus, and a communicating portion to the atmosphere, characterized by comprising a waste ink absorbing member, a liquid non-absorbing film disposed between said waste ink absorbing member and an inner wall of the cartridge and having an area in a substantially close contact state with the inner wall of the cartridge, and an ink storage body directly disposed on an upper portion of said waste ink absorbing member and containing the ink for use in recording by the ink recording apparatus and a delivery portion for delivering the ink externally.

2. A waste ink receiving cartridge detachable from an ink recording apparatus and internally provided with a liquid absorbing member, extending in a longitudinal direction and having an external surface, for receiving waste ink from the recording apparatus, characterized by comprising a liquid non-absorbing sheet member for dispersing waste ink at least in the longitudinal direction of said liquid absorbing member along the external surface of said liquid absorbing member.

3. A waste ink receiving cartridge according to claim 2, characterized in that said sheet member is interposed along a bottom surface of said cartridge between said liquid absorbing member and said bottom surface.

4. A waste ink receiving cartridge according to claim 2, characterized in that said waste ink receiving cartridge comprises an ink storage portion for storing the ink to be supplied to the recording apparatus which is directly disposed upon said liquid absorbing member within said waste ink receiving cartridge, thereby pressing said sheet member against the bottom surface of said cartridge.

5. A waste ink receiving cartridge according to claim 2, characterized in that said liquid absorbing member, said sheet member and a bottom surface of said cartridge are separated from each other, and wherein said liquid absorbing member is a porous body expansible with the absorption of the waste ink, and said sheet member is longer in the longitudinal direction than said liquid absorbing member in an initial state before said liquid absorbing member absorbs the waste ink.

6. A waste ink receiving cartridge according to claim 2, characterized in that said waste ink receiving cartridge comprises a projection portion for forming a minute space exhibiting capillary action between the bottom surface of said cartridge and said sheet member.

7. A waste ink receiving cartridge according to claim 4, characterized in that said liquid absorbing member is expansible toward the ink storage portion, and can maintain said ink storage substantially portion at a substantially fixed position.

8. A waste ink receiving cartridge according to claim 2, characterized by further comprising a waste ink diffusion layer for diffusing waste ink on a lower surface of said liquid non-absorbing sheet member.

9. A waste ink receiving cartridge according to claim 8, characterized in that said waste ink diffusion layer is made of a water soluble, low molecule weight compound, having a viscosity substantially within the range of 50 cp to 300 cp.

10. A waste ink receiving cartridge detachable from an ink recording apparatus and internally provided with a liquid absorbing member, extending in a longitudinal direction and having an external surface, for receiving waste ink from the recording apparatus, characterized by comprising a liquid non-absorbing sheet member for dispersing waste ink at least in a longitudinal direction of said liquid absorbing member along an external surface of said liquid absorbing member, and wherein said sheet member first receives waste ink from the ink recording apparatus prior to said liquid absorbing member.

11. A waste ink receiving cartridge according to claim 10, characterized in that said sheet member is interposed along a bottom surface of said cartridge between said liquid absorbing member and said bottom surface, and said liquid absorbing member is contained except for a region where said cartridge receives waste ink.

12. A waste ink receiving cartridge according to claim 10, characterized in that said sheet member comprises opening portions opposed to said liquid absorbing member.

13. A waste ink receiving cartridge according to claim 10, characterized in that said sheet member is located along the bottom surface of said cartridge under a lower surface of said liquid absorbing member, and provided with a plurality of opening portions opposed to said liquid absorbing member.

14. A waste ink receiving cartridge according to claim 13, characterized in that said liquid absorbing member is a porous body which substantially evenly expands with the adsorption said waste ink through the opening portions of said sheet member, and supports an ink storage portion disposed on said liquid absorbing member from the underside.

15. A waste ink receiving cartridge detachable from an ink recording apparatus and internally provided with a waste ink receiving member for receiving waste ink from the recording apparatus, characterized by comprising a waste ink absorbing member, and a liquid non-absorbing film disposed between said waste ink absorbing member and an inner wall of the cartridge and having an area in a substantially contact state with the inner wall of the cartridge.

16. A waste ink receiving cartridge according to claim 15, further comprising a thin ink guide layer said non-absorbing film.

17. A waste ink receiving cartridge detachable from an ink recording apparatus, internally having a liquid absorbing member, extending in a longitudinal direction and having an external surface, for receiving waste ink from the recording apparatus, characterized by comprising a liquid non-absorbing sheet member for dispersing waste ink at least in the longitudinal direction of said liquid absorbing member along an external surface of said liquid absorbing member, and which is interposed along a bottom surface of said cartridge between said liquid absorbing member and said bottom surface, in order to distribute waste ink from said recording apparatus between said bottom surface and said sheet and over said sheet surface into said liquid absorbing member.

18. A recording apparatus characterized by comprising recording means containing an electricity-heat conversion body generating heat energy for discharging an ink in accordance with a recording signal, recovery means for stabilizing the recording capability of said recording means, and a waste ink receiving cartridge detachable from the recording apparatus and internally comprising a liquid absorbing member, extending in a longitudinal direction and having an external surface, for receiving waste ink from said recovery means, and a liquid non-absorbing sheet member for dispersing waste ink at least in the longitudinal direction of said liquid absorbing member provided along an external surface of said liquid absorbing member, and which is interposed along a bottom surface of said cartridge between said liquid absorbing member and said bottom surface, in order to distribute waste ink from said recording apparatus between said bottom surface and said sheet and over said sheet surface into said liquid absorbing member.

19. A waste ink receiving cartridge detachable from an ink recording apparatus and internally provided with a liquid absorbing member for receiving waste ink from the recording apparatus, characterized in that said liquid absorbing member is constituted of a porous material expansible with the content of said waste ink, and comprising an ink storage portion for storing the ink to be supplied to the apparatus on said liquid absorbing material, wherein said liquid absorbing material is disposed so as to support said ink storage portion at a substantially fixed portion upon expansion of said liquid absorbing material; and a liquid non-absorbing sheet member between an external surface of said liquid absorbing member and said cartridge, wherein waste ink is passed over said liquid non-absorbing member and absorbed into said liquid absorbing member, and wherein said ink storage portion is supported by expansion of said liquid absorbing member and maintained almost at a fixed position.

20. An ink receiving cartridge detachable from an ink recording apparatus and internally having an ink storage member for storing an ink to be supplied to the recording apparatus, and a liquid absorbing member, extending in a longitudinal direction and having an external surface, for receiving waste ink from the recording apparatus, characterized by comprising a liquid non-absorbing sheet member for dispersing waste ink at least in the longitudinal direction of said liquid absorbing member along an external lower surface of said liquid absorbing member, and an information medium used for transmitting a characteristic of the stored ink in a portion of an upper surface of the cartridge body.

21. An ink receiving cartridge according to claim 20, wherein the area for receiving said waste ink and the area for containing said information medium are located in left and right regions of the cartridge separated by the ink delivery portion for delivering the ink from said ink storage member to the apparatus.

22. An ink receiving cartridge according to claim 20, wherein said ink delivery portion is formed with a recess on an upper surface of cartridge.

23. An ink recording apparatus comprising:

ink recording means for discharging ink onto a recording member;

conveying means for conveying the recording medium on which ink is discharged from said ink recording means to form an image;

an ink cartridge including an ink containing member for storing ink to be supplied to said ink recording means and a liquid absorbing member, extending in a longitudinal direction and having an external surface, for collecting ink which is exhausted from said ink recording means and is not used for recording; and ink supply means for connecting said ink cartridge with said ink recording means to supply ink to said ink recording means, wherein said ink cartridge has a non-absorbing sheet member for directing exhausted ink with respect to at least the longitudinal direction of said liquid absorbing member and an exhausted ink guiding tube for guiding said exhausted ink to said non-absorbing sheet member prior to said liquid absorbing member.

24. An ink recording apparatus according to claim 23, characterized in that an end portion of said exhausted ink guiding tube is positioned at an exhausted ink receiving region where said liquid absorbing member is not opposed within said sheet member disposed along a bottom surface of said cartridge between said liquid absorbing member and said bottom surface.

25. An ink recording apparatus according to claim 23, characterized in the said ink recording means for said ink recording apparatus comprises an electricity-heat conversion body for causing film boiling by applying the heat energy to the ink, and recording signal issuing means for said electricity-heat conversion body.

26. An ink recording apparatus comprising:

a housing;

ink recording means for discharging ink onto a recording medium, said ink recording means having an electrothermal converting element for applying thermal energy to effect film boiling causing ink to be discharged from an ink discharge port;

conveying means for conveying a recording medium on which ink is discharged from said ink recording means to form an image;

an ink cartridge including an ink containing member for storing ink to be supplied to said ink recording means and a liquid absorbing member for collecting ink which is exhausted from said ink recording means and is not used for recording, said ink cartridge having a non-absorbing sheet member between said housing of said cartridge and an outer surface of said liquid absorbing member; and ink supply means for connecting said ink cartridge with said ink recording means to supply ink to said ink recording means.

27. A recording apparatus according to claim 26, characterized in that said ink containing member is directly disposed upon said liquid absorbing member for receiving exhausted ink, and further comprising an atmosphere communicating portion, wherein said sheet member is pressed against a bottom surface of said cartridge.

28. A recording apparatus according to claim 27, wherein said liquid absorbing member is a porous body expansible with waste ink absorbed through opening portions of said sheet member.

29. A recording apparatus according to claim 27, wherein said sheet member comprises opening portions opposed to said liquid absorbing member, so that waste ink absorbed through said opening portions is almost evenly dispersed over said liquid absorbing member, and wherein said liquid absorbing member expands uniformly the waste ink substantially evenly dispersed, therein and supports an ink storage portion from the underside to maintain the ink storage portion at a substantially fixed position.

* * * * *

UNITED STATES PATENT AND TRADEMARK OFFICE

CERTIFICATE OF CORRECTION

PATENT NO. : 5,221,935

DATED : June 22, 1993

INVENTOR(S) : TOSHIHIKO UZITA

It is certified that error appears in the above-identified patent and that said Letters Patent is hereby corrected as shown below:

COLUMN 1

Line 49, "to" should be deleted.
Line 51, "a" should read --an--.

COLUMN 5

Line 54, "state" should read --state,--.

COLUMN 7

Line 56, "in closely" should read --closely in--.

COLUMN 9

Line 16, "them" should be deleted.
Line 31, "extends" should read --extend--.
Line 52, "the" should be deleted.

COLUMN 12

Line 2, "almost" should read --approximately--.
Line 50, "o." should read --$\alpha$.--.
Line 56, "a fixed" should read --so that a fixed--.
Line 68, "a+o" should read --a+$\alpha$--.

COLUMN 13

Line 6, "a+c" should read --a+$\alpha$--.

--

UNITED STATES PATENT AND TRADEMARK OFFICE

CERTIFICATE OF CORRECTION

PATENT NO. : 5,221,935

DATED : June 22, 1993

INVENTOR(S) : TOSHIHIKO UZITA

It is certified that error appears in the above-identified patent and that said Letters Patent is hereby corrected as shown below:

COLUMN 15

Line 24, "and a" should read --and an--.
Line 55, "are" should read --is--.

COLUMN 17

Line 25, "leak" should read --leak and--.
Line 26, "contaminate" should read --contamination--.
Line 51, "Sn<Sn<Sg<5Sn." should read --Sn<Sg<5Sn.--.

COLUMN 21

Line 67, "substantially" should be deleted.

COLUMN 22

Line 7, "molecule" should read --molecular--.
Line 56, "said" should read --on said--.

COLUMN 23

Line 35, "portion" should read --position--.
Line 67, "cartridge." should read --said cartridge.--.

COLUMN 24

Line 31, "the" should read --that--.

--

UNITED STATES PATENT AND TRADEMARK OFFICE

CERTIFICATE OF CORRECTION

PATENT NO. : 5,221,935

DATED : June 22, 1993

INVENTOR(S) : TOSHIHIKO UZITA

It is certified that error appears in the above-identified patent and that said Letters Patent is hereby corrected as shown below:

COLUMN 26

Line 1, "uniformly" should read --uniformly with-- and "dispersed," should read --dispersed--.
Line 2, "therein" should read --therein,--.

Signed and Sealed this

Nineteenth Day of April, 1994

Bruce Lehman

*Attest:*

BRUCE LEHMAN

*Attesting Officer*

*Commissioner of Patents and Trademarks*

--